United States Patent [19]

Dixit et al.

[11] Patent Number: 4,892,673

[45] Date of Patent: Jan. 9, 1990

[54] NON-AQUEOUS, NONIONIC HEAVY DUTY LAUNDRY DETERGENT WITH IMPROVED STABILITY

[75] Inventors: Nagaraj S. Dixit, Kendall Park; Robert J. Rhinesmith, Somerset; James J. Sullivan, New Brunswick; Cynthia A. Barone, Colts Neck; Richard P. Adams, Kendall Park; Kuo-Yann Lai, Plainsboro, all of N.J.

[73] Assignee: Colgate-Palmolive Company, New York, N.Y.

[21] Appl. No.: 188,947

[22] Filed: May 2, 1988

[51] Int. Cl.[4] ..... C11D 17/00

[52] U.S. Cl. ..... 252/114; 252/122; 252/135; 252/139; 252/174.21; 252/DIG. 14

[58] Field of Search ..... 252/DIG. 14, 174.21, 252/111, 114, 115, 122, 135, 139

[56] References Cited

U.S. PATENT DOCUMENTS 4,264,466 4/1981 Carleton et al. ..... 252/174.25

4,752,409 6/1988 Drapier et al. ..... 252/94

*Primary Examiner*—A. Lionel Clingman

*Assistant Examiner*—Hoa Van Le

*Attorney, Agent, or Firm*—Norman Blumenkopf; Murray M. Grill; Robert L. Stone

[57] ABSTRACT

A non-aqueous liquid heavy duty laundry detergent composition in the form of a suspension of builder salt in liquid nonionic surfactant is stabilized against phase separation by the incorporation of gas bubbles having an average particle size diameter of 10 to 100 microns. The gas bubbles are incorporated in an amount to equalize the densities of the continuous liquid phase and the dispersed phase. The gas bubbles are stabilized by incorporation of a stabilizer having the formula wherein R is a hydrocarbon group of about 5 to 21 carbon atoms, Q is a hydrogen atom, a Group IA metal, a Group IIA metal, a group having the formula —$CH_2$—$CH(R^1)$—$CH_2(R^2)$, or a mixture thereof, wherein $R^1$ and $R^2$ are, independently, —OH or R-C(O)O— (R being as defined above); and a is 1 or 2, with the proviso that a=2 only when Q is a Group IIA metal.

61 Claims, 6 Drawing Sheets

NON-AQUEOUS, NONIONIC HEAVY DUTY LAUNDRY DETERGENT WITH IMPROVED STABILITY

BACKGROUND OF THE INVENTION (1) Field of Invention

This invention relates to stabilization of non-aqueous liquid suspensions, especially non-aqueous liquid fabric-treating compositions. More particularly, this invention relates to nonaqueous liquid laundry detergent compositions which are made stable against phase separation under both static and dynamic conditions and are easily pourable, to the method of preparing these compositions and to the use of these compositions for cleaning soiled fabrics.

(2) Discussion of Prior Art

Liquid nonaqueous heavy duty laundry detergent compositions are well known in the art. For instance, compositions of this type may comprise a liquid nonionic surfactant in which are dispersed particles of a builder, as shown for instance in U.S. Pat. Nos. 4,316,812; 3,630,929; 4,254,466; and 4,661,280.

Liquid detergents are often considered to be more convenient to employ than dry powdered or particulate products and, therefore, have found substantial favor with consumers. They are readily measurable, speedily dissolved in the wash water, capable of being easily applied in concentrated solutions or dispersions to soiled areas on garments to be laundered and are non-dusting, and they usually occupy less storage space. Additionally, the liquid detergents may have incorporated in their formulations materials which could not stand drying operations without deterioration, which materials are often desirably employed in the manufacture of particulate detergent products.

Although they are possessed of many advantages over unitary or particulate solid products, liquid detergents often have certain inherent disadvantages too, which have to be overcome to produce acceptable commercial detergent products. Thus, some such products separate out on storage and others separate out on cooling and are not readily redispersed. In some cases the product viscosity changes and it becomes either too thick to pour or so thin as to appear watery. Some clear products become cloudy and others gel on standing.

The present inventors have been extensively involved as part of an overall corporate research effort in studying the rheological behavior of nonionic liquid surfactant systems with particulate matter suspended therein. Of particular interest have been non-aqueous, built, liquid laundry detergent compositions and the problems of phase separation and settling of the suspended builder and other laundry additives. These considerations have an impact on, for example, product pourability, dispersibility and stability.

It is known that one of the major problems with built, liquid laundry detergents is their physical stability. This problem stems from the fact that the density of the solid suspended particles is higher than the density of the liquid matrix. Therefore, the particles tend to sediment according to Stoke's law. Two basic solutions exist to solve the sedimentation problem: increasing liquid matrix viscosity and/or reducing solid particle size.

For instance, it is known that such suspensions can be stabilized against settling by adding inorganic or organic thickening agents or dispersants, such as, for example, very high surface area inorganic materials, e.g.

finely divided silica, clays, etc., organic thickeners, such as the cellulose ethers, acrylic and acrylamide polymers, polyelectrolytes, etc. However, such increases in suspension viscosity are naturally limited by the requirement that the liquid suspension be readily pourable and flowable, even at low temperature. Furthermore, these additives do not contribute to the cleaning performance of the formulation. U.S. Pat. No. 4,661,280 to T. Ouhadi, et al. discloses the use of aluminum stearate for increasing stability of suspensions of builder salts in liquid nonionic surfactant. The addition of small amounts of aluminum stearate increases yield stress without increasing plastic viscosity.

According to U.S. Pat. No. 3,985,668 to W. L. Hartman, an aqueous false body fluid abrasive scouring composition is prepared from an aqueous liquid and an appropriate colloid-forming material, such as clay or other inorganic or organic thickening or suspending agent, especially smectite clays, and a relatively light, water-insoluble particulate filler material, which, like the abrasive material, is suspended throughout the false body fluid phase. The lightweight filler has particle size diameters ranging from 1 to 250 microns and a specific gravity less than that of the false body fluid phase. It is suggested by Hartman that inclusion of the relatively light, insoluble filler in the false body fluid phase helps to minimize phase separation, i.e. minimize formation of a clear liquid layer above the false body abrasive composition, first, by virtue of its buoyancy exerting an upward force on the structure of the colloid-forming agent in the false body phase counteracting the tendency of the heavy abrasive to compress the false body structure and squeeze out liquid. Second, the filler material acts as a bulking agent replacing a portion of the water which would normally be used in the absence of the filler material, thereby resulting in less aqueous liquid available to cause clear layer formation and separation.

British Application G.B. No. 2,168,377A, published June 18, 1986, discloses aqueous liquid dishwashing detergent compositions with abrasive, colloidal clay thickener and low density particulate filler having particle sizes ranging from about 1 to about 250 microns and densities ranging from about 0.01 to about 0.5 g/cc, used at a level of from about 0.07% to about 1% by weight of the composition. It is suggested that the filler material improves stability by lowering the specific gravity of the clay mass so that it floats in the liquid phase of the composition. The type and amount of filler is selected such that the specific gravity of the final composition is adjusted to match that of the clear fluid (i.e. the composition without clay or abrasive materials).

It is also known to include an inorganic insoluble thickening agent or dispersant of very high surface area such as finely divided silica of extremely fine particle size (e.g. of 5–100 millimicrons diameter such as sold under the name Aerosil) or the other highly voluminous inorganic carrier materials as disclosed in U.S. Pat. No. 3,630,929.

It has long been known that aqueous swelling colloidal clays, such as bentonite and montmorillonite clays, can be modified by exchange of the metallic cation groups with organic groups, thereby changing the hydrophilic clays to organophilic clays. The use of such organophilic clays as gel-forming clays has been described in U.S. Pat. No. 2,531,427 to E. A. Hauser.

Improvements and modifications of the organophilic gel-forming clays are described, for example, in the following U.S. Pat. Nos.: 2,966,5061 —Jordan; 4,105,578—Finlayson, et al.; 4,208,218—Finlayson; 4,287,086—Finlayson; 4,434,075—Mardis, et al.; 4,434,076—Mardis, et al.; all assigned to NL Industries, Inc., formerly National Lead Company. According to these NL patents, these organophilic clay gellants are useful in lubricating greases, oil based muds, oil base packer fluids, paints, paint-varnish-lacquer removers, adhesives, sealants, inks, polyester gel coats and the like. However, use as a stabilizer in a nonaqueous liquid detergent composition for laundering fabrics has not been suggested.

On the other hand, the use of clays in combination with quaternary ammonium compounds (often referred to as "QA" compounds) to impart fabric softening benefits to laundering compositions has been described.. For instance, mention can be made of the British Patent Application G.B. No. 2,141,152 A, published Dec. 12, 1984, to P. Ramachandran, and the many patents referred to therein for fabric softening compositions based on organophilic QA clays.

According to the aforementioned U.S. Pat. No. 4,264,466 to Carleton, et al., the physical stability of a dispersion of particulate materials, such as detergent builders, in a nonaqueous liquid phase is improved by using as a primary suspending agent an impalpable chain structure type clay, including sepiolite, attapulgite, and palygorskite clays. The patentees state and the comparative examples in this patent show that other types of clays, such as montmorillonite clay, e.g. Bentolite L, hectorite clay (e.g. Veegum T) and kaolinite clay (e.g., Hydrite PX), even when used in conjunction with an auxiliary suspension aid, including cationic surfactants, inclusive of QA compounds, are only poor suspending agents. Carleton, et al. also refer to use of other clays as suspension aids and mention, as examples, U.S. Pat. Nos. 4,049,034 and 4,005,027 (both aqueous systems); and U.S. Pat. Nos. 4,166,039; 3,259,574; 3,557,037 and 3,549,542; and U.K. Patent Application No. 2,017,072.

Commonly assigned copending application Ser. No. 063,199, filed June 12, 1987 (Atty's Docket IR-347LG) discloses incorporation into non-aqueous liquid fabric treating compositions of up to about 1% by weight of an organophilic water-swellable smectite clay modified with a cationic nitrogen-containing compound including at least one long chain hydrocarbon having from about 8 to about 22 carbon atoms to form an elastic network or structure throughout the suspension to increase the yield stress and increase stability of the suspension.

While the addition of the organophilic clay improves stability of the suspension, still further improvements are desired, especially for particulate suspensions having relatively low yield values for optimizing dispensing and dispersion during use.

Grinding to reduce the particle size as a means to increase product stability provides the following advantages:

(1) the particle specific surface area is increased, and, therefore, particle wetting by the non-aqueous vehicle (liquid non-ionic) is proportionately improved; and (2) the average distance between pigment particles is reduced with a proportionate increase in particle-to-particle interaction.

Each of these effects contributes to increase the rest-gel strength and the suspension yield stress while at the same time, grinding significantly reduces plastic viscosity.

The above-mentioned U.S. Patent 4,316,812 discloses the benefits of grinding solid particles, e.g., builder and bleach, to an average particle diameter of less than 10 microns. However, it has been found that merely grinding to such small particle sizes does not, by itself, impart sufficient long term stability against phase separation.

In the commonly assigned copending application filed on July 15, 1987 in the names of N. Dixit, et al. under Ser. No. 073,653 (Attorney's Docket IR-4494), and titled "STABLE NONAQUEOUS CLEANING COMPOSITION CONTAINING LOW DENSITY FILLER AND METHOD OF USE" the use of low density filler material for stabilizing suspensions of finely divided solid particulate matter in a liquid phase against phase separation by equalizing the densities of the dispersed particle phase and the liquid phase is disclosed. These modified liquid suspensions exhibit excellent phase stabilization when left to stand for extended periods of time, e.g., up to 6 months or longer or even when subjected to moderate shaking. However, it has recently been observed that when the low-density filler modified suspensions are subjected to strong vibrations, such as may be encountered during transportation by rail, truck, etc., the homogeneity of the dispersion is degraded as a portion of the low density filler migrates to the upper surface of the liquid suspension.

In commonly assigned, copending application Ser. No. 073,551, filed July 15, 1987 in the name of Cao et al. entitled "Stable Non-Aqueous Suspension Containing Organophilic Clay And low Density Filler" the use of low density filler material for stabilizing suspensions of finely divided solid particulate matter in a liquid phase against phase separation is disclosed as being improved by the incorporation of organophilic modified clays which aid in resisting the destabilizing effect of strong vibrations.

Nonetheless, still further improvements are desired in the stability of non-aqueous liquid fabric treating compositions.

SUMMARY OF THE INVENTION

Accordingly, it is an object of this invention to provide liquid fabric treating compositions which are suspensions of insoluble fabric-treating particles in a nonaqueous liquid and which are storage and transportation stable, easily pourable and dispersible in cold, warm or hot water.

Another object of this invention is to formulate highly built heavy duty non-aqueous liquid nonionic surfactant laundry detergent compositions which resist settling of the suspended solid particles or separation of the liquid phase.

A more general object of the invention is to provide a method for improving the stability of suspensions of finely divided solid particulate matter in a non-aqueous liquid matrix by incorporating gas bubbles, having an average size of from about 10 to about 100 microns, into the suspension whereby the gas bubbles can interact with the solid particulate matter of higher density to equalize the densities of the suspended particle phase and the density of the continuous, non-aqueous liquid phase.

These and other objects of the invention which will become more apparent hereinafter have been accomplished based on the inventors' discovery that by adding a small amount of a stabilizer, having the formula

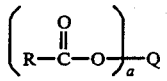

wherein

R is a hydrocarbon group of about 5 to 21 carbon atoms,

Q is a hydrogen atom, a Group IA metal, a Group IIA metal, a group having the formula

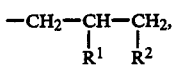

or a mixture thereof, wherein $R^1$ and $R^2$ are, independently,

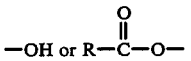

(R being as defined above), and a is 1 or 2, with the proviso that a=2 only when Q is a Group IIA metal, to a liquid suspension of at least one particulate detergent builder salt in at least one nonionic surfactant, stable suspended gas bubbles may be introduced into the suspension to inhibit the tendency of the particulate detergent builder salt to settle out of suspension.

According to another aspect, the invention provides a method for cleaning soiled fabrics by contacting the soiled fabrics with the liquid non-ionic laundry detergent composition as described above.

According to still another aspect of the invention, a method is provided for stabilizing a suspension of a first finely divided particulate solid substance in a continuous liquid vehicle phase, the suspended solid particles having a density greater than the density of the liquid phase, which method involves adding to the suspension of solid particles an amount of gas bubbles such that the density of the dispersed solid particles together with the gas bubbles becomes similar to the density of the liquid phase and a small amount of stabilizer to stabilize the gas bubbles in the suspension.

In the preferred embodiment of special interest herein the liquid phase of the composition of this invention is comprised predominantly or totally of liquid nonionic synthetic organic detergent. A portion of the liquid phase may be composed, however, of organic solvents which may enter the composition as solvent vehicles or carriers for one or more of the solid particulate ingredients, such as in enzyme slurries, perfumes, and the like. Also as will be described in detail below, organic solvents, such as alcohols and ethers, may be added as viscosity control and anti-gelling agents.

BRIEF DESCRIPTION OF THE DRAWING FIGURES

DETAILED DESCRIPTION OF THE INVENTION

Figure 1:
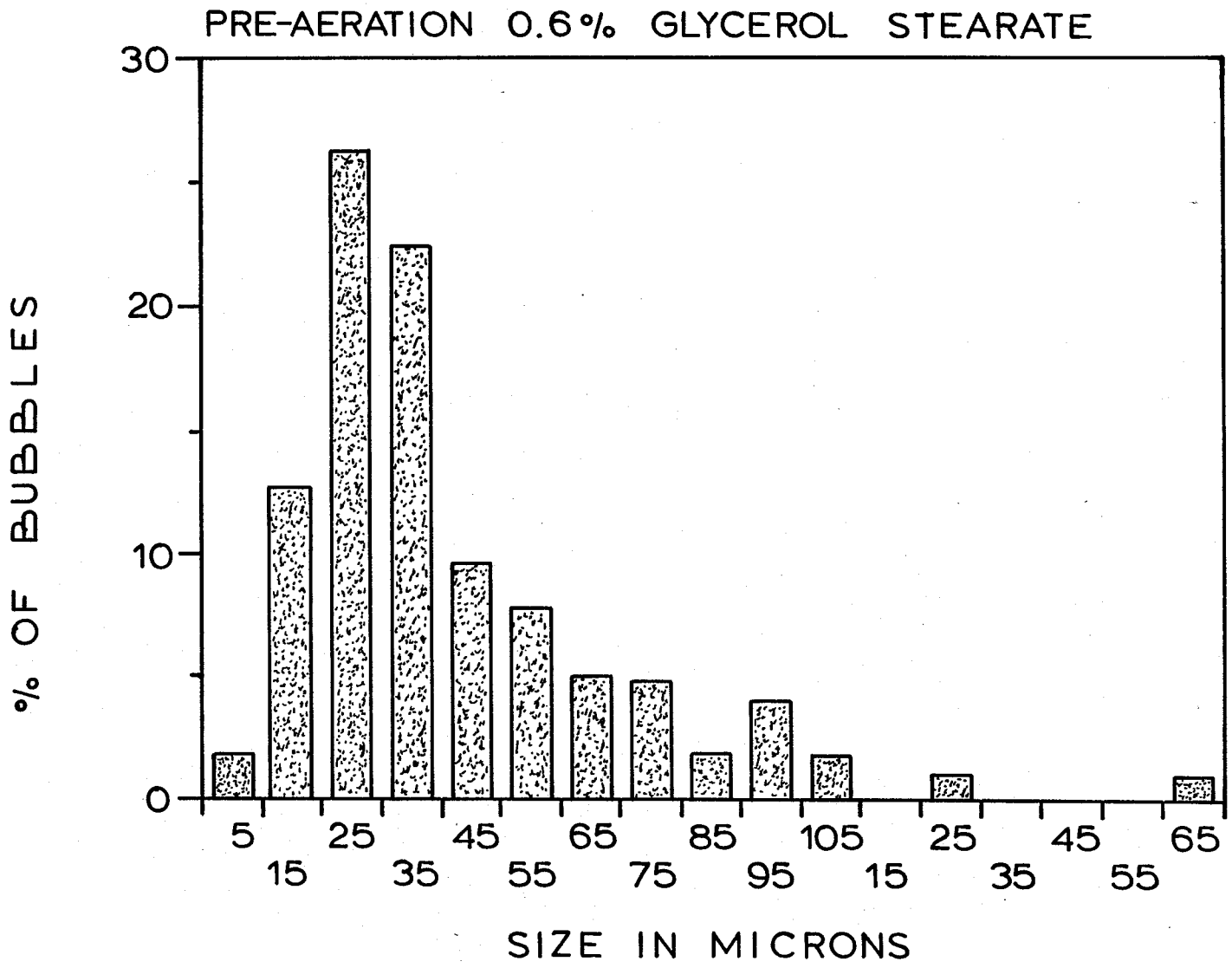
FIG. 1 is a bar graph showing the bubble size distribution produced with a glycerol stearate as air stabilizer using a pre-aeration technique (during grinding).

The nonionic synthetic organic detergents employed in the practice of the invention may be any of a wide variety of such compounds, which are well known and, for example, are described at length in the text Surface Active Agents, Vol. II, by Schwartz, Perry and Berch, published in 1958 by Interscience Publishers, and in McCutcheon's Detergents and Emulsifiers, 1969 Annual, the relevant disclosures of which are hereby incorporated by reference. Usually, the nonionic detergents are poly-lower alkoxylated lipophiles wherein the desired hydrophile-lipophile balance is obtained from addition of a hydrophilic poly-lower alkoxy group to a lipophilic moiety. A preferred class of the nonionic detergent employed is the poly-lower alkoxylated higher alkanol wherein the alkanol is of 10 to 22 carbon atoms and wherein the number of mols of lower alkylene oxide (of 2 or 3 carbon atoms) is from 3 to 20. Of such materials it is preferred to employ those wherein the higher alkanol is a higher fatty alcohol of about 12 to 18 carbon atoms and which contain from 3 to 14, preferably 3 to 12 lower alkoxy groups per mol. The lower alkoxy is often just ethoxy but in some instances, it may be desirably mixed with propoxy, the latter, if present, often being in a minor (less than 50%) proportion. Exemplary of such compounds are those wherein the alkanol is of 12 to 15 carbon atoms and which contain about 7 ethylene oxide groups per mol, e.g., Neodol 25-7 and Neodol 23-6.5, which products are made by Shell Chemical Company, Inc. The former is a condensation product of a mixture of higher fatty alcohols averaging about 12 to 15 carbon atoms, with about 7 mols of ethylene oxide and the latter is a corresponding mixture wherein the carbon atom content of the higher fatty alcohol is 12 to 13 and the number of ethylene oxide groups present averages about 6.5. The higher alcohols are primary alkanols. Other examples of such detergents include Tergitol 15-S-7 and Tergitol 15-S-9, both of which are linear secondary alcohol ethoxylates made by Union Carbide Corp. The former is mixed ethoxylation product of 11 to 15 carbon atoms linear secondary alkanol with seven mols of ethylene oxide and the latter is a similar product but with nine mols of ethylene oxide being reacted.

Also useful in the present compositions as a component of the nonionic detergent are higher molecular weight nonionics, such as Neodol 45-11, which are similar ethylene oxide condensation products of higher fatty alcohols, with the higher fatty alcohol being of 14 to 15 carbon atoms and the number of ethylene oxide groups per mol being about 11. Such products are also made by Shell Chemical Company. Another preferred class of useful nonionics are represented by the commercially well known class of nonionics which are the reaction product of a higher linear alcohol and a mixture of ethylene and propylene oxides, containing a mixed chain of ethylene oxide and propylene oxide, terminated by a hydroxyl group. Examples include the nonionics sold under the Plurafac trademark of BASF, such as Plurafac RA30, Plurafac RA40 (a $C_{13}$–$C_{15}$ fatty alcohol condensed with 7 moles propylene oxide and 4 moles ethylene oxide), Plurafac D25 (a $C_{13}$–$C_{15}$ fatty alcohol condensed with 5 moles propylene oxide and 10 moles ethylene oxide), Plurafac B26, and Plurafac RA50 (a mixture of equal parts Plurafac D25 and Plurafac RA40).

Generally, the mixed ethylene oxide-propylene oxide fatty alcohol condensation products represented by the general formula $$RO(C_3H_6O)_p(C_2H_4O)_qH,$$

wherein R is a straight or branched primary or secondary aliphatic hydrocarbon, preferably alkyl or alkenyl, especially preferably alkyl, of from 6 to 20, preferably 10 to 18, especially preferably 12 to 18 carbon atoms, p is a number of up to 14, preferably 3 to 8, and q is a number of up to 14, preferably 3 to 12, can be advantageously used where low foaming characteristics are desired. In addition, these surfactants have the advantage of low gelling temperatures.

Another group of liquid nonionics are available from Shell Chemical Company, Inc. under the Dobanol trademark: Dobanol 91-5 is an ethoxylated $C_9$–$C_{11}$ fatty alcohol with an average of 5 moles ethylene oxide; Dobanol 25-7 is an ethoxylated $C_{12}$–$C_{15}$ fatty alcohol with an average of 7 moles ethylene oxide; etc.

In the preferred poly-lower alkoxylated higher alkanols, to obtain the best balance of hydrophilic and lipophilic moieties the number of lower alkoxies will usually be from 40% to 100% of the number of carbon atoms in the higher alcohol, such as 40 to 60% thereof and the nonionic detergent will often contain at least 50% of such preferred poly-lower alkoxy higher alkanol.

Higher molecular weight alkanols and various other normally solid nonionic detergents and surface active agents may be contributory to gelation of the liquid detergent and consequently, will preferably be omitted or limited in quantity in the present compositions, although minor proportions thereof may be employed for their cleaning properties, etc. With respect to both preferred and less preferred nonionic detergents the alkyl groups present therein are generally linear although branching may be tolerated, such as at a carbon next to or two carbons removed from the terminal carbon of the straight chain and away from the alkoxy chain, if such branched alkyl is not more than three carbons in length. Normally, the proportion of carbon atoms in such a branched configuration will be minor rarely exceeding 20% of the total carbon atom content of the alkyl. Similarly although linear alkyls which are terminally joined to the alkylene oxide chains are highly preferred and are considered to result in the best combination of detergency, biodegradability and non-gelling characteristics, medial or secondary joinder to the alkylene oxide in the chain may occur. It is usually in only a minor proportion of such alkyls, generally less than 20% but, as is the case of the mentioned Tergitols, may be greater. Also, when propylene oxide is present in the lower alkylene oxide chain, it will usually be less than 20% thereof and preferably less than 10% thereof.

When greater proportions of non-terminally alkoxylated alkanols, propylene oxide-containing poly-lower alkoxylated alkanols and less hydrophile-lipophile balanced nonionic detergent than mentioned above are employed and when other nonionic detergents are used instead of the preferred nonionics recited herein, the product resulting may not have as good detergency, stability, viscosity and non-gelling properties as the preferred compositions but use of viscosity and gel controlling compounds can also improve the properties of the detergents based on such nonionics. In some cases, as when a higher molecular weight poly-lower alkoxylated higher alkanol is employed, often for its detergency, the proportion thereof will be regulated or limited in accordance with the results of routine experiments, to obtain the desired detergency and still have the product non-gelling and of desired viscosity. Also, it has been found that it is only rarely necessary to utilize the higher molecular weight nonionics for their detergent properties since the preferred nonionics described herein are excellent detergents and additionally, permit the attainment of the desired viscosity in the liquid detergent without gelation at low temperatures. Mixtures of two or more of these liquid nonionics can also be used and in some cases advantages can be obtained by the use of such mixtures.

In view of their low gelling temperatures and low pour points, another preferred class of nonionic surfactants includes the C12–C13 secondary fatty alcohols with relatively narrow contents of ethylene oxide in the range of from about 7 to 9 moles, especially about 8 moles ethylene oxide per molecule and the C9 to C11, especially C10 fatty alcohols ethoxylated with about 6 moles ethylene oxide.

Furthermore, in the compositions of this invention, it may be advantageous to include an organic solvent or diluent which can function as a viscosity control and gel-inhibiting agent for the liquid nonionic surface active agents. Lower ($C_1$–$C_6$) aliphatic alcohols and glycols, such as ethanol, isopropanol, ethylene glycol, hexylene glycol and the like have been used for this purpose. Polyethylene glycols, such as PEG 400, are also useful diluents. Alkylene glycol ethers, such as the compounds sold under the trademarks, Carbopol and Carbitol which have relatively short hydrocarbon chain lengths (C2–C8) and a low content of ethylene oxide (about 2 to 6 EO units per molecule) are especially useful viscosity control and anti-gelling solvents in the compositions of this invention. This use of the alkylene glycol ethers is disclosed in the commonly assigned copending application Ser. No. 687,815, filed Dec. 31, 1984, to T. Ouhadi, et al. the disclosure of which is incorporated herein by reference. Suitable glycol ethers can be represented by the following general formula $$RO(CH_2CH_2O)_nH$$

where R is a $C_2$–$C_8$, preferably $C_2$–$C_5$ alkyl group, and n is a number of from about 1 to 6, preferably 1 to 4, on average.

Specific examples of suitable solvents include ethylene glycol monoethyl ether ($C_2H_5$—O —$CH_2CH_2OH$), diethylene glycol monobutyl ether ($C_4H_9$—O—$(CH_2CH_2O)_2H$), tetraethylene glycol monooctyl ether ($C_8H_{17}$—O—$(CH_2CH_2O)_4H$), etc. Diethylene glycol monobutyl ether is especially preferred.

Another useful antigelling agent which can be included as a minor component of the liquid phase, is an aliphatic linear or aliphatic monocyclic dicarboxylic acid, such as the C6 to C12 alkyl and alkenyl derivatives of succinic acid or maleic acid, and the corresponding anhydrides or an aliphatic monocyclic dicarboxylic acid compound. The use of these compounds as antigelling agents in non-aqueous liquid heavy duty built laundry detergent compositions is disclosed in the commonly assigned, copending application Ser. No. 756,334, filed July 18, 1985, the disclosure of which is incorporated herein in its entirety by reference thereto.

Briefly, these gel-inhibiting compounds are aliphatic linear or aliphatic monocyclic dicarboxylic acid compounds. The aliphatic portion of the molecule may be saturated or ethylenically unsaturated and the aliphatic linear portion may be straight of branched. The aliphatic monocylic molecules may be saturated or may include a single double bond in the ring. Furthermore, the aliphatic hydrocarbon ring may have 5- or 6-carbon atoms in the ring, i.e. cyclopentyl, cyclopentenyl, cyclohexyl, or cyclohexenyl, with one carboxyl group bonded directly to a carbon atom in the ring and the other carboxyl group bonded to the ring through a linear alkyl or alkenyl group.

The aliphatic linear dicarboxylic acids have at least about 6 carbon atoms in the aliphatic moiety and may be alkyl or alkenyl having up to about 14 carbon atoms, with a preferred range being from about 8 to 13 carbon atoms, especially preferably 9 to 12 carbon atoms. One of the carboxylic acid groups (—COOH) is preferably bonded to the terminal (alpha) carbon atom of the aliphatic chain and the other carboxyl group is preferably bonded to the next adjacent (beta) carbon atom or it may be spaced two or three carbon atoms from the $\alpha$-position, i.e. on the $\alpha$- or $\Delta$- carbon atoms. The preferred aliphatic dicarboxylic acids are the $\alpha,\beta$-dicarboxylic acids and the corresponding anhydrides, and especially preferred are derivatives of succinic acid or maleic acid and have the general formula:

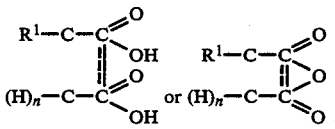

wherein $R^1$is an alkyl or al kenyl group of from about 6 to 12 carbon atoms, preferably 7 to 11 carbon atoms, especially preferably 8 to 10 carbon atoms, wherein n=1, when ═══ is a double bond and n=2, when ═══ is a single bond.

The alkyl or alkenyl group may be straight or branched. The straight chain alkenyl groups are especially preferred. It is not necessary that $R^1$ represent a single alkyl or alkenyl group and mixtures of different carbon chain lengths may be present depending on the starting materials for preparing the dicarboxylic acid.

The aliphatic monocyclic dicarboxylic acid may be either 5- or 6-membered carbon rings with one or two linear aliphatic groups bOnded to ring carbon atoms. The linear aliphatic groups should have at least about 6, preferably at least about 8, especially preferably at least about 10 carbon atoms, in total, and up to about 22, preferably up to about 18, especially preferably up to about 15 carbon atoms. When two aliphatic carbon atoms are present attached to the aliphatic ring they are preferably located para- to each other. Thus, the preferred aliphatic cyclic dicarboxylic acid compounds may be represented by the following structural formula

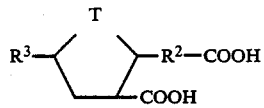

where

—T— represents —$CH_2$—, —CH═, —$CH_2$—$CH_2$—or —CH═CH—;

$R_2$ represents an alkyl or alkenyl group of from 3 to 12 carbon atoms; and $R^3$ represents a hydrogen atom or ah alkyl or alkenyl group of from 1 to 12 carbon atoms, with the proviso that the total number of carbon atoms in $R^2$ and $R^3$ is from about 6 to about 22.

Preferably —T— represents —$CH_2$—$CH_2$—or —CH═CH—, especially preferably —CH═CH—.

$R^2$ and $R^3$ are each preferably alkyl groups of from about 3 to about 10 carbon atoms, especially from about 4 to about 9 carbon atoms, with the total umber of carbon atoms in $R^2$ and $R^3$ being from about 8 to about 15. The alkyl or alkenyl groups may be straight of branched but are preferably straight chains.

The amount of the nonionic surfactant is generally within the range of from about 20 to about 70%, such as about 22 to 60% for example 25%, 30%, 35% or 40% by weight of the composition. The amount of solvent o diluent when present is usually up to 20%, preferably up to 1%, for example, 0.5 to 15%, preferably 5.0 to 12%. The weight ratio of nonionic surfactant to alkylene glycol ether as the viscosity control and antigelling agent, when the latter is present, as in the preferred embodiment of the invention is in the range of from about 100:1 to 1:1, preferably from about 50:1 to about 2:1, such as 10:1, 8:1, 6:1, 4:1 or 3:1. Accordingly, t e continuous non-aqueous liquid phase may comprise from about 30% to about 70% by weight of the composition, preferably from about 50% to about 60%.

The amount of the dicarboxylic acid gel-inhibiting compound, when used, will be dependent on such factors as the nature of the liquid nonionic surfactant, e.g. its gelling temperature, the nature of the dicarboxylic acid, other ingredients in the composition which might influence gelling temperature, and the intended use (e.9. with hot or cold water, geographical climate, and so on). Generally, it is possible to lower the gelling temperature to no higher than about 3° C., preferably no higher than about 0° C, with amounts of dicarboxylic acid anti-gelling agent in the range of about 1% to about 30%, preferably from about 1.5% to about 1%, by weight, based on the weight of the liquid nonionic surfactant, although in any particular case the optimum amount can be readily determined by routine experimentation.

The invention detergent compositions in the preferred embodiment also include as an essential ingredient water-soluble and/or water-dispersible detergent builder salts. Typical suitable builders include, for example, those disclosed in the aforementioned U.S. Pat. Nos. 4,316,812. 4,264,466, 3,630,929, and many others. Water-soluble inorganic alkaline builder salts which can be used alone with the detergent compound or in admixture with other builders are alkali metal carbonates, borates, phosphates, polyphosphates, bicarbonates, and silicates. (Ammonium or substituted ammonium salts can also be used.) Specific examples of such salts are sodium tripolyphosphate, sodium carbonate, sodium tetraborate, sodium pyrophosphate, potassium pyrophosphate, sodium bicarbonate, potassium tripolyphosphate, sodium hexametaphosphate, sodium sesquicarbonate, sodium mono and diorrhophosphate, and potassium bicarbonate. Sodium tripolyphosphate (TPP) is especially preferred where phosphate containing ingredients are not prohibited due to environmental concerns. The alkali metal silicates are useful builder salts which also function to make the composition anticorrosive to washing machine parts. Sodium silicates of $Na_2O/SiO_2$ ratios of from 1.6/1 to 1/3.2, especially about ½ to ½.8 are preferred. Porassium silicates of the same ratios can also be used.

Another class of builders a[e the water-insoluble aluminosilicates, both of the crystalline and amorphous type. Various crystalline zeolites (i.e. aluminosilicates) are described in British Pat. No. 1,504,168. U.S. Pat. No. 4,409,136 and Canadian Pat. Nos. 1,072,835 and 1,087,477, all of which are hereby incorporated by reference for such descriptions. An example of amorphous zeolites useful herein can be found in Belgium Pat. No. 835,351 and this patent too is incorporated herein by reference. The zeolites generally have the formula $$(M_2O)x\cdot(Al_2O_3)_y\cdot(SiO_2)_z\cdot WH_2O$$

wherein x is 1, y is from 0.8 to 1.2 and preferably 1, z is from 1.5 to 3.5 or higher and preferably 2 to 3 and W is from 0 to 9, preferably 2.5 to 6 and M is preferably sodium. A typical zeolite is type A or similar structure, with type 4A particularly preferred. The preferred aluminosilicates have calcium ion exchange capacities of about 200 milliequivalents per gram or greater, e.g. 400 meq/o g.

Examples of organic alkaline sequestrant builder salts which can be used alone with the detergent or in admixture with other organic and inorganic builders are alkali metal, ammonium or substituted ammonium, aminopolycarboxylates, e.g. sodium and potassium ethylene diaminetetraacetate (EDTA), sodium and potassium nitrilotriacetates (NTA) and triethanolammonium N-(2hydroxyethyl)nitrilodiacetates. Mixed salts of these polycarboxylates are also suitable.

Other suitable builders of the organic type include carboxymethylsuccinates, tartronates and glycollates and the polyacetal carboxylates. The polyaceral carboxylates and their use in detergent compositions are described in 4,144,226; 4,315,092 and 4,146,495. Other patents on similar builders include 4,141,676; 4,169,934; 4,201,858; 4,204,852; 4,224,420; 4,225,685; 4,226,960; 4,233,422; 4,233,423; 4,302,564 and 4,303,777. Also relevant are European Patent Application Nos. 0015024, 0021491 and 0063399.

The proportion of the suspended detergent builder, based on the total composition, is usually in the range of from about 30 to 70 weight percent, such as about 20 to 50 weight percent, for example about 40 to 50 weight percent of the composition.

According to the present invention, the physical stability of the suspension of the detergent builder salt or salts or any other finely divided suspended solid particulate additive, such as bleaching agent, pigment, etc., in the liquid vehicle is drastically improved by the presence of gas bubbles, having an average size of from about 10 to about 100 microns, in an amount effective to substantially inhibit settling of the finely divided suspended solid particles. Preferably, the gas bubbles are present in an amount to substantially equalize the density of the continuous, non-aqueous liquid phase and the density of the suspended particle phase, inclusive of the gas bubbles and the at least one detergent builder salt.

The gas may be any material which is normally gaseous under the expected handling and shipping conditions of the liquid fabric treating composition, e.g., at least in the range of −40° C. to +50° C. Preferably, the gas is substantially inert to the components of the liquid fabric treating composition, and will not degrade the detergency, etc. of the liquid fabric treating composition. Suitable gases include the inert gases, such as helium, neon and argon, as well as carbon dioxide, nitrogen, and air. Nitrogen and/or air are preferred due to their ready availability, especially air.

Within the foregoing general criteria, suitable gaseous materials have very low densities as compared to the other materials forming the liquid fabric treating composition, e.g., the density of air at about 23° C is about 0.001 g/cc, and the diameters of suitable gas bubbles are from about 10 to about 100 microns, preferably about 20 to about 70 microns, most preferably about 20 to 30 microns. Gas bubble size is determined by microscopic examination. (Gas bubble size, unless otherwise indicated, is reported as the mean bubble size for the lower 75% of observed bubbles, larger bubbles generally being unstabilized and readily dissipated from the system.)

One of the features of the present invention is that the amount of the gas bubbles added to the non-aqueous liquid suspension is such that the mean (average) statistically weighted densities of the suspended particles and the gas bubbles is the same as or not greatly different from the density of the liquid phase (inclusive of nonionic surfactant and other solvents, liquids and dissolved ingredients). What this means, in practical terms, is that the density of the entire composition, after addition of the gas bubbles, is approximately the same, or the same as the density of the liquid phase alone.

Therefore, the amount of gas bubbles to be added will depend on the density of the gas bubbles, the density of the liquid phase alone and the density of the total composition excluding the gas bubbles. For any particular starting liquid dispersion the amount of gas bubbles required will increase as the density of the particulates increases and conversely, a smaller amount of gas bubbles will be required to effect a given reduction in density of the final composition as the density of the particulates decreases.

The amount of gas bubbles required to equalize the densities of the liquid phase (known) and the dispersed phase can be theoretically calculated using the following equation which is based on the assumption of ideal mixing of the gas bubbles and non-aqueous dispersion:

$$\frac{Mms}{Mf} = \frac{d_{ms}}{d_{liq}} \; \frac{d_o - d_{liq}}{d_o - d_{ms}}$$

where (Mms/mf) represents the mass fraction of gas bubbles to be added to the suspension to make the final composition density equal to the liquid density;

$d_{ms}$=liquid displacement density of the gas bubbles;

$d_{liq}$=liquid phase of suspension;

$d_o$=density of starting composition (i.e. suspension before addition of gas bubbles);

Mf=mass of final composition (i.e. after addition of gas bubbles); and

Mms=mass of gas bubbles to be added.

Generally, the amount of gas bubbles required to equalize dispersed phase density and liquid phase density will be within the range of from about 0.005 to 1.0% by weight, preferably about 0.005 to 0.010% by weight, based on the weight of the non-aqueous dispersion.

Although it is preferred to make the liquid phase density and dispersed phase density equal to each other, i.e. $d_{liq}/d_{sf}=1.0$, to obtain the highest degree of stability, small differences in the densities, for example $d_{liq}/d_{sf}=0.90$ to 1.10, especially 0.95 to 1.05, (where dsf is the final density of the dispersed phase after addition of the gas bubbles) will still give acceptable stabilities in most cases, generally manifested by absence of phase separation, e.g. no appearance of a clear liquid phase, for at least 3 to 6 months or more.

As just described, the present invention requires the addition to the non-aqueous liquid suspension of finely divided fabric treating solid particles of an amount of gas bubbles sufficient to provide a mean statistically weighted density of the solid particles and gas bubbles which is similar to the density of the continuous liquid phase. However, merely having a statistically weighted average density of the dispersed phase similar to the density of the liquid phase would not appear by itself to explain how or why the gas bubbles exert their stabilizing influence, since the final composition still includes the relatively dense dispersed fabric treating solid particles, e.g. phosphates, which should normally settle and the gas bubbles which should normally rise in the liquid phase.

Although not wishing to be bound by any particular theory, it is presumed, and experimental data and microscopic observations appear to confirm, that the dispersed detergent additive solid particles, such as builder, bleach, and so on, actually are attracted to and adhere and form a mono- or polylayer of dispersed particles surrounding the gas bubbles, forming "composite" particles which, in effect, function as single unitary particles. These composite particles can then be considered to have a density which closely approximates a volume weighted average of the densities of 11 the individual particles forming the composite particles:

$$d_{cp} = \frac{d_H + \frac{V_L}{V_H} d_L}{1 + \frac{V_L}{V_H}}$$

where $d_{cp}$=density of composite particle;

$d_H$=density of dispersed phase (heavy particle);

$d_L$=density of gas (gas bubble);

$V_H$=total volume of dispersed phase particles in composite;

$V_L$=total volume of gas in composite.

However, in order for the density of the composite particle to be similar to that of the liquid phase, it is necessary that a large number of dispersed particles interact with each of the ga bubbles, for example, depending on relative densities, tens, hundreds or even thousands of the dispersed (heavy) particles may associate with each gas bubble.

Accordingly, it is another feature of the compositions and method of this invention that the average particle size diameter of the gas bubble must be greater than the average particle size diameter of the dispersed phase particles, such as detergent builder, etc., in order to accommodate the large number of dispersed particles on the surface of the filler particle. In this regard, it has been found that the ratio of the average particle size diameter of the gas bubbles to the average particle size diameter of the dispersed particles must be from about 1:1 to 10:1, especially 3:1 to 9:1, with best results being achieved at a ratio of about 6:1 to 9:1. At diameter ratios smaller than 3:1, although some improvement in stabilization may occur, depending on the relative densities of the dispersed particles and gas and the density of the liquid phase, satisfactory results will not generally be obtained.

Therefore, for the preferred range of average particle size diameter for the gas bubbles of 0 to 70 microns, especially 20 to 30 microns, the dispersed phase particles should have average particle size diameters of from about 1 to 10 microns, especially 4 to 5 microns. These particle sizes can be obtained by suitable grinding as described below.

In order to ensure that the gas bubbles remain dispersed in the liquid fabric treating composition for a sufficient period to impart storage stability, e.g., about 3 to 6 months, it has been found necessary to incorporate an air bubble stabilizing amount of a stabilizer having the formula

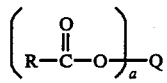

wherein

R is a hydrocarbon carbon atoms,

Q is a hydrogen atom, a Group IA metal, a Group IIA metal, a group having the formula $-CH_2CH(R^1)CH_2(R^2)$ *or a mixture thereof, wherein R1* and $R^2$ are, independently, —OH or RC(O)O—(R being as defined above), and a is 1 or 2, with the proviso that a=2 only when Q is a Group IIA metal.

Typically, the stabilizer is used in an amount of about 0.01% to about 5.0% by weight of the composition, preferably from about 0.5% to about 4.0% and most preferably from about 0.5% to about 1.5% by weight.

In one embodiment, where Q=H, the stabilizer comprises a fatty acid having between 6 to 22 carbon atoms, preferably about 12 to 20 carbon atoms and most preferably about 16 to 18 carbon atoms. The group R may be linear or branched, saturated or unsaturated. Representative acids include lauric, myristic, palmitic, stearic and oleic. Mixtures of acids may also be utilized such as a mixture of palmitic and stearic acids. Such a product is commercially available under the trade name Emersol 132 ® (Emery Chemical, about 50% palmitic and about 45% stearic).

In another embodiment, where 0 is a Group IA metal (lithium, sodium, potassium, etc.) or a Group IIA metal (magnesium, calcium, etc.), the stabilizer comprises an alkali metal or an alkaline earth metal salt of a fatty acid having between 6 and 22 carbon atoms, preferably about 12 to 20 carbon atoms and most preferably about 16 to 18 carbon atoms. The group R may be linear or branched, saturated or unsaturated. Representative acid salts include sodium stearate, sodium oleate, potassium stearate and calcium stearate Preferably, an alkali metal salt of a fatty acid is utilized since such salts are water-soluble, most preferably sodium oleate is utilized. In addition to the stabilization of gas bubbles, the use of sodium oleate has also been found to improve fabric brightening.

In a particularly preferred embodiment, where Q is a group having the formula $—CH_2—CH(R^1)—CH_2(R^2)$, as defined above, the stabilizer comprises a glycerol ester of a fatty acid having between 6 and 22 carbon atoms, preferably about 12 to 20 carbon atoms and most preferably 16 to 18 carbon atoms. The group R may be linear or branched, saturated or unsaturated. Representative glycerol esters include glycerol monostearate, glycerol distearate, glycerol tristearate, glycerol monooleate, glycerol dioleate, glycerol monopalmitate, etc. Preferably, a mixture of glycerol esters is utilized, especially mixtures of a glycerol monoester and a glycerol diester. In a particularly preferred embodiment, a mixture of glycerol monostearate and glycerol distearate is utilized. Such a mixture is commercially available from Witco Chemical and comprises about 65% glycerol monostearate and about 30% glycerol distearate. In addition to the stabilization of gas bubbles, the use of glycerol stearate provides superior cold water dispersibility for the fabric treating composition.

In a further particularly preferred embodiment, the aforementioned mixture of glycerol monostearate and glycerol distearate is used in conjunction with a minor amount, relative to the mixture of stearates, of a fatty alcohol having from 12 to 20 carbon atoms. The alcohol may be linear or branched, saturated or unsaturated. Representative alcohols include dodecanol, tetradecanol, hexadecanol and octadecanol. Preferably, octadecanol is utilized. The fatty alcohol is typically used in an amount of about 1/10 that of the mixture of glycerides.

Other surfactants may also be used to stabilize the gas bubbles, either alone or in conjunction with the aforementioned stabilizers. Such additional surfactants must be relatively insoluble in the non-aqueous liquid phase (i.e. the nonionic surfactant and/or any additional solvents); capable of producing a low interfacial tension ar the air bubble-liquid interface; and must possess functional groups capable of H-bonding; as are the aforementioned stabilizers.

Such additional surfactants include sulfonated and sulfated surfactants such as sodium lauryl sulfate, Dowfax 3B2®, Dowfax 2A1®; and the alkonyl amides represented by the formula $$HO—C_2H_4—\underset{\underset{R^3}{|}}{N}—C(O)—R^4$$

wherein $R^3$ is a hydrogen atom or a lower alkyl group of up to carbon atoms, and atoms.

$R^4$ is an alkyl group of from about 6 to about 22 carbon

Moreover, any of the aforementioned stabilizers can also be used in conjunction with a minor amount, relative to said stabilizer, of a quaternary ammonium salt of the formula $$\left(R^6—\overset{\overset{R^5}{|}}{\underset{\underset{CH_3}{|}}{N}}^{+}—CH_3\right) X^-$$

wherein $R^5$ is a hydrocarbon group of about 8 to about 22 carbon atoms, preferably about 16 to about 18 carbon atoms, $R_6$ is a lower aliphatic group of up to about 6 carbon atoms, an aromatic group, especially phenyl, or an alkaryl group, especially benzyl, and X is an inorganic or organic anion, such as $F^-$, $Cl^-$, $Br^-$, $HCOO^-$ or $CH_3COO^-$.

In preparing the compositions of the present invention, the stabilizer, generally in a flaked or powdered form, is admixed with the other solid ingredients and the liquid components, either in a conventional mixing apparatus, such as a crutcher-type mixer, followed by transfer to a milling apparatus or directly in a milling apparatus. In this latter case, the mill rotor of an Attritor ball mill may be employed to mix the components. In a particularly preferred embodiment of the invention, the stabilizer is first thoroughly mixed with the other solid ingredients, and then this admixture of solid components is mixed with the liquid components.

Subsequent to complete admixture of the components, the mixture is subjected to a grinding and aeration process to grind the particulate material to the previously indicated particle size (e.g., 1–10 microns, preferably 4–5 microns average particle diameter) and to incorporate gas bubbles in the desired amount.

The grinding and aeration process may take place simultaneously (pre-aeration) or sequentially. In the latter case, grinding precedes aeration (post-aeration). However, there is no significant difference in result between the two cases.

In particular, simultaneous grinding and aeration may take place in an open system type mill such as an Attritor ball mill. In this case, a cover may be utilized which permits grinding under a controlled atmosphere, e.g., dry nitrogen, so as to control the nature of the gas introduced as bubbles into the liquid suspension. This technique may be utilized to prevent atmospheric moisture up-take which mat cause variations in viscosity between batches.

Sequential grinding and aeration may be carried out by use of a closed system type mill such as a mill utilizing a Molinex-type rotor. In this case, subsequent aeration may be effected under relatively mild aerobic mixing conditions, e.g. mixing with a propeller or a Rustin blade to cause entrainment of air in the liquid suspension by generation of a cavity (vortex) in the liquid suspension.

Introduction of air has been found to be temperature dependent with air incorporation increasing as temperature decreases. Preferably, air incorporation, either during grinding or subsequent to grinding is carried but at a temperature of 80° F. or less, preferably less than 75° F., most preferably between about 55° and 70° F.

Additionally, a low density filler may also be incorporated into the present compositions, in lieu of a portion of the entrained gas bubbles.

The low density filler may be any inorganic or organic particulate matter which is insoluble in the liquid phase and/or solvents used in the composition and is compatible with the various components of the composition. In addition, the filler particles should possess sufficient mechanical strength to sustain the shear stress expected to be encountered during product formulation, packaging, shipping and use. The low density filler, depending on its mechanical strength, may be incorporated during post-aeration or during a separate blending step subsequent to completion of aeration.

Within the foregoing general criteria suitable particulate filler materials have effective densities in the range of from about 0.01 to 0.50 g/cc. especially about 0.01 to 0.20 g/cc, particularly, 0.02 to 0.20 g/cc, measured at room temperature, e.g. 23° C, and particle size diameters in the range of from about 1 to 300 microns, preferably 4 to 200 microns, with average particle size diameters ranging from about 20 to 100 microns, preferably from about 30 to 0 microns.

The types of inorganic and organic fillers which have such low bulk densities are generally hollow microspheres or microballoons or at least highly porous solid particulate matter.

For example, either inorganic or organic microspheres, such as various organic polymeric microspheres or glass bubbles,are preferred. Specific, nonlimiting examples of organic polymeric material microspheres include polyvinylidene chloride, polystyrene, polyethylene, polypropylene, polyethylene terephthalate, polyurethanes, polycarbonates, polyamides and the like. More generally, any of the low density particulate filler materials disclosed in the aforementioned G.B. Pat. No. 2,168,377A at page 4, lines 43–55, including those referred to in the Moorehouse, et al. and Wolinski, et al. patents can be used in the non-aqueous compositions of this invention. In addition to hollow microspheres other low density inorganic filler materials may also be used, for example aluminosilicate zeolites, spray-dried clays, etc.

However, preferably, the light weight filler is formed from a water-soluble material. This has the advantage that when used to wash soiled fabrics in an aqueous wash bath the water-soluble particles will dissolve and, therefore, will not deposit on the fabric being washed. In contrast the water-insoluble filler particles can more easily adhere to or be adsorbed on or to the fibers or surface of the laundered fabric.

As a specific example of such light weight filler which is insoluble in the non-aqueous liquid phase of the invention composition but which is soluble in water mention can be made of sodium borosilicate glass, such as the hollow microspheres available under the tradename Q-Cell, particularly Q-Cell 400, Q-Cell 200, Q-Cell 500 and so on. These materials have the additional advantage of providing silicate ions in the wash bath which function as anticorrosion agents.

As examples of water soluble organic material suitable for production of hollow microsphere low density particles mention can be made, for example, of starch, hydroxyethylcellulose, polyvinyl alcohol and polyvinylpyrrolidone, the latter also providing functional properties as a soil suspending agent when dissolved in the aqueous wash bath.

Since the compositions of this invention are generally highly concentrated, and, therefore, may be used at relatively low dosages, it is often desirable to supplement any phosphate builder (such as sodium tripolyphosphate) with an auxiliary builder such as a polymeric carboxylic acid having high calcium binding capacity to inhibit incrustation which could otherwise be caused by formation of an insoluble calcium phosphate. Such auxiliary builders are also well known in the art. For example, mention can be made of Sokolan CP5 which is a copolymer of about equal moles of methacrylic acid and maleic anhydride, completely neutralized to form the sodium salt thereof. The amount of the auxiliary builder is generally up to about 6 weight percent, preferably ¼ to 4%, such as 1%, 2% or 3%, based on the total weight of the composition. Of course, the present compositions, where required by environmental constraints, can be prepared without any phosphate builder.

In addition to the detergent builders, various other detergent additives or adjuvants may be present in the detergent product to give it additional desired properties, either of functional or aesthetic nature. Thus, there may be included in the formulation, minor amounts of soil suspending or antiredeposition agents, e.g. polyvinyl alcohol, fatty amides, sodium carboxymethyl cellulose, hydroxy-propyl methyl cellulose, usually in amounts of up to 10 weight percent, for example 0.1 to 10%, preferably 1 to 5%; optical brighteners, e.g. cotton, polyamide and polyester brighteners, for example, stilbene, triazole and benzidine sulfone compositions, especially sulfonated substituted triazinyl stilbene, sulfonated naphthotriazole stilbene, benzidine sulfone, etc., most preferred are stilbene and triazole combinations. Typically, amount of the optical brightener up to about 2 weight percent, preferably up to 1 weight percent, such as 0.1 to 0.8 weight percent, can be used.

Bluing agents such as ultramarine blue; enzymes, preferably proteolytic enzymes, such as subtilisin, bromelin, papain, trypain and pepsin, as well as amylase type enzymes, lipase type enzymes, and mixtures thereof; bactericides, e.g. tetrachlorosalicylanilide, hexachlorophene; fungicides; dyes; pigments (water dispersible); preservatives; ultraviolet absorbers; anti-yellowing agents, such as sodium carboxymethyl cellulose, complex of $C_{12}$ to $C_{22}$ alkyl alcohol with $C_{12}$ to $C_{18}$ alkylsulfate; pH modifiers and pH buffers; color safe bleaches, perfume, and anti-foam agents or suds-suppressor, e.g. silicon compounds can also be used.

The bleaching agents are classified broadly for convenience, as chlorine bleaches and oxygen bleaches. Chlorine bleaches are typified by sodium hypochlorite (NaOCl), potassium dichloroisocyanurate (59% available chlorine), and trichloroisocyanuric acid (95% available chlorine). Oxygen bleaches are preferred and are represented by percompounds which liberate hydrogen peroxide in solution. Preferred examples include sodium and potassium perborates, percarbonates, and perphosphates, and potassium monopersulfate. The perborates, particularly sodium perborate monohydrate, are especially preferred.

The peroxygen compound is preferably used in admixture with an activator therefor. Suitable activators which can lower the effective operating temperature of the peroxide bleaching agent are disclosed, for example, in U S. Patent 4,264,466 or in column 1 of U.S. Pat. No. 4,430,244, the relevant disclosures of which are incorporated herein by reference. Polyacylated compounds are preferred activators; among these, compounds such as tetraacetyl ethylene diamine ("TAED") and pentaacetyl glucose are particularly preferred.

Other useful activators include, for example, acetylsalicylic acid derivatives, ethylidene benzoate acetate and its salts, ethylidene carboxylate acetate and its salts, alkyl and alkenyl succinic anhydride, tetraacetylglycouril ("TAGU"), and the derivatives of these. Other useful classes of activators are disclosed, for example, in U.S. Pat. Nos. 4,111,826, 4,422,950 and 3,661,789.

The bleach activator usually interacts with the peroxygen compound to form a peroxyacid bleaching agent in the wash water. It is preferred to include a sequestering agent of high complexing power to inhibit any undesired reaction between such peroxyacid and hydrogen peroxide in the wash solution in the presence of metal ions. Preferred sequestering agents are able to form a complex with Cu2+ions, such that the stability constant (pK) of the complexation is equal to or greater than 6, at 25° C., in water, of an ionic strength of 0.1 mole/liter, pK being conventionally defined by the formula: pK =-log K where K represents the equilibrium constant. Thus, for example, the pK values for complexation of copper ion with NTA and EDTA at the stated conditions are 12.7 and 18.8, respectively. Suitable sequestering agents include, for example, in addition to those mentioned above, the compounds sold under the Dequest trademark, such as, for example, diethylene triamine pentaacetic acid (DETPA); diethylene triamine pentamethylene phosphoric acid (DTPMP); and ethylene diamine tetramethylene phosphoric acid (EDITEMPA).

In order to avoid loss of peroxide bleaching agent, e.g. sodium perborate, resulting from enzyme-induced decomposition, such as by catalase enzyme, the compositions may additionally include an enzyme inhibitor compound, i.e. a compound capable of inhibiting enzyme-induced decomposition of the peroxide bleaching agent. Suitable inhibitor compounds are disclosed in U.S. Pat. No. 3,606,990, the relevant disclosure of which is incorporated herein by reference.

Of special interest as the inhibitor compound, mention can be made of hydroxylamine sulfate and other water-soluble hydroxylamine salts. In the preferred nonaqueous compositions of this invention, suitable amounts of the hydroxylamine salt inhibitors can be as low as about 0.0to 0.4%. Generally, however, suitable amounts of enzyme inhibitors are up to about 15%, for example, 0.1 to 10%, by weight of the composition.

Another potentially useful stabilizer for use in conjunction with the low density filler, is an acidic organic phosphorus compound having an acidic-OH group, as disclosed in the commonly assigned copending application Ser. No. 781,189,filed Sept. 25, 1985, to Broze, et al., the disclosure of which is incorporated h rein by reference thereto. The acidic organic phosphorus compound, may be, for instance, a partial ester of phosphoric acid and an alcohol, such as an alkanol having a lipophilic character, having, for instance, more than 5 carbon atoms, e.g. 8 to 20 carbon atoms. A specific example is a partial ester of phosphoric acid and a C16 to C18 alkanol. Empiphos 5632 from Marchon is made up of about 35% monoester and 65% diester. When used amounts of the phosphoric acid compound up to about 3%, preferably up to 1%, are sufficient.

As disclosed in copending application Ser. No. 926,851, filed Nov. 3, 1986, to Broze, et al., the disclosure of which is incorporated herein by reference, a nonionic surfactant which has been modified to convert a free hydroxyl group to a moiety having a free carboxyl group, such as a partial ester of a nonionic surfactant and a polycarboxylic acid, can be incorporated into the composition to further improve rheological properties. For instance, amounts of the acid-terminated nonionic surfactant of up to 1 per part of the nonionic surfactant, such as 0.1 to 0.8 part, are sufficient.

Suitable ranges of these optional detergent additives are: enzymes—0 to 2%, especially 0.1 to 1.3%; corrosion inhibitors—about 0 to 40%, and preferably 5 to 30%; anti-foam agents and suds-suppressor—0 to 15%. preferably 0 to 5%, for example 0.1 to 3%; thickening agent and dispersants—0 to 15%, for example 0.1 to 10%, preferably 1 to 5%; soil suspending or anti-redeposition agents and anti-yellowing agents—0 to 10%, preferably 0.5 to 5%; colorants, perfumes, brighteners and bluing agents total weight 0% to about 2% and preferably 0% to about 1%; pH modifiers and pH buffers—0 to 5%, preferably 0 to 2%; bleaching agent—0% to about 40% and preferably 0% to about 25%, for example 2 to 20%; bleach stabilizers and bleach activators 0 to about 15%, preferably 0 to 10%, for example, 0.1 to 8%; enzyme-inhibitors 0 to 15%, for example, 0.01 to 15%, preferably 0.1 to 10%; sequestering agent of high complexing power, in the range of up to about 5%, preferably ¼ to 3%, such as about ¼. to 2%. In the selections of the adjuvants, they will be chosen to be compatible with the main constituents of the detergent composition.

In a preferred form of the invention, the mixture of liquid nonionic surfactant and solid ingredients (other than low density filler) is subjected to grinding, for example, by a sand mill or ball mill. Especially useful are the attrition types of mill, such as those sold by Wiener-Amsterdam or Netzsch-Germany, for example, in which the particle sizes of the solid ingredients are reduced to about 1–10 microns, e.g. to an average particle size of 4 to 5 microns or even lower (e.g. 1 micron). Preferably less than about 10%, especially less than about 5 of all the suspended particles have particle sizes greater than 15 microns, preferably 10 microns. In view of increasing costs in energy consumption as particle size decreases it is often preferred that the average particle size be at least 3 microns, especially about 4 microns. Other types of grinding mills, such as toothmill, peg mill and the like, may also be used.

In the grinding operation, t is preferred that the proportion of solid ingredients be high enough (e.g. at least about 40%, such as about 50%) that the solid particles are in contact with each other and are not substantially shielded from one another by the nonionic surfactant liquid. Mills which employ grinding balls (ball mills) or similar mobile grinding elements have given very good results Thus, one may use a laboratory batch attritor having 8 mm diameter steatite grinding balls. For larger scale work a continuously operating mill in which there are 1 mm or 1.5 mm diameter grinding balls working in a very small gap between a stator and a rotor operating at a relatively high speed (e.g. a CoBall will) may be employed; when using such a mill, it is desirable to pass the blend of nonionic surfactant and solids first through a mill which does not effect such fine grinding (e.g. a colloid mi 1) to reduce the particle size to less than 100 microns (e.g. to about 40 microns) prior to the step of grinding to an average particle diameter below about 18 or 15 microns in the continuous ba 1 mill.

Alternatively, the powdery solid particles may be finely ground to the desired size before blending with the liquid matrix, for instance, in a jet-mill.

The final compositions of this invention are nonaqueous liquid suspensions, generally exhibiting non-Newtonian flow characteristics. The compositions, after addition of a low density filler, are slightly thixotropic, namely exhibit reduced viscosity under applied stress or shear, and behave, rheologically, substantially according to the Casson equation. Furthermore, the compositions have vicosities at room temperature measured using a Brookfield, Model RVTD viscometer, with No. 4 spindle, at 10 r.p.m., ranging from about 5,000 to 25,000 centipoise, usually from about 6,000 to 23,000 centipoise. However, when shaken or subjected to stress, such as being squeezed through a narrow opening in a squeeze tube bottle, for example, the product is readily flowable. Thus, the compositions of this invention may conveniently be packaged in ordinary vessels, such as glass or plastic, rigid or flexible bottles, jars or other container, and dispensed therefrom directly into the aqueous wash bath, such as in an automatic washing machine, in usual amounts, such as ¼ to ½ cups, for example, ½ cup, per laundry load (to approximately 3 to 15 pounds, for example), for each load of laundry, usually in 8 to 18 gallons of water. The preferred compositions will remain stable (no more than 1 or 2 mm liquid phase separation) when left to stand for periods of 3 to 6 months or longer.

It is understood that the foregoing detailed description is given merely by way of illustration and that variations may be made therein without departing from the spirit of the invention.

It should also be understood that as used in the specification and in the appended claims the term "non-aqueous" means absence of water, however, small; amounts of water, for example up to about 5%, preferably up to about 2%, may be tolerated in the compositions and, therefore, "non-aqueous" compositions can include such small amounts of water, whether added directly or as a carrier or solvent for one of the other ingredients in the composition.

The liquid fabric treating compositions of this invention may be packaged in conventional glass or plastic vessels and also in single use packages, such as the doserrettes and disposable sachet dispensers disclosed in the commonly assigned copending application Serial No. 063,199, filed June 12, 1987 , the disclosure of which is incorporated herein by reference thereto.

The invention will now be described by way of the following non-limiting examples in which all proportions and percentages are by weight, unless otherwise indicated. Also, atmospheric pressure is used unless otherwise indicated.

EXAMPLE 1

Tergotometer tests were performed on the compositions set forth in Table 1. The compositions were prepared by grinding the solids with the liquid surfactant in an Attritor ball mill (450 rpm, 50 minutes, $N_2$ atmosphere). Reflectance values, select viscosity values and select density values are also set forth in Table 1.

TABLE 1

| COMPONENT | RUN NO. 1 | 2 | 3 | 4 | 5 | 6 | 7 |
|---|---|---|---|---|---|---|---|
| Tergitol 15-S-7 | 40 | 40 | 40 | 40 | 40 | 40 | 40 |
| Tergitol 24-L-60N | 9 | 9 | 9 | 9 | 9 | 9 | 9 |
| Silicone Defoamer DB-100 (Dow Corning) | .05 | 05 | 05 | 05 | .05 | .05 | .05 |
| Sodium Tripolyphosphate | 30.35 | 29.85 | 29.35 | 28.35 | 27.35 | 26.35 | 25.35 |
| Sodium Perborate Monohydrate | 11<br>4.5 | 11<br>4.5 | 11<br>4.5 | 11<br>4.5 | 11<br>4.5 | 11<br>4.5 | 11<br>4.5 |

TABLE 1-continued

| COMPONENT | RUN NO. 1 | 2 | 3 | 4 | 5 | 6 | 7 |
|---|---|---|---|---|---|---|---|
| TAED[1] | 2.0 | 2.0 | 2.0 | 2.0 | 2.0 | 2.0 | 2.0 |
| Sokolan CP-5 Polymer (BASF) | 2.0 | 2.0 | 2.0 | 2.0 | 2.0 | 2.0 | 2.0 |
| CMC[2] | 2.0 | 2.0 | 2.0 | 2.0 | 2.0 | 2.0 | 2.0 |
| Maxatase Enzyme | 0.6 | 0.6 | 0.6 | 0.6 | 0.6 | 0.6 | 0.6 |
| CBS-X Brightener | 0.3 | 0.3 | 0.3<br>0.3 | 0.3 | 0.3 | 0.3 | |
| $TiO_2$ | 0.2 | 0.2 | 0.2 | 0.2 | 0.2 | 0.2 | 0.2 |
| Sodium Oleate | 0 | 0.5 | 1.0 | 2.0 | 3.0 | 4.0 | 5.0 |
| $R_b$[3] | 53.0 | 59.3 | 61.3 | 66.3 | 71.3 | 70.0 | 70.3 |
| $N_{10}$ rpm (cp)[4] | 1770 | — | — | — | 7850 | — | — |
| Density (g/cc) | 1.35 | — | — | — | 1.14 | — | — |

[1]TAED = tetra-acetyl ethylene diamine
[2]CMC = carboxy methyl cellulose
[3]UV light reflectance on 3 cotton swatches - average reading
[4]Brookfield RTVD viscometer, No. 4 spindle, 10 rpm The increase in brightness due to the addition of sodium oleate was optimized at three percent. Overall performance in washing machine tests showed no decrease in detergency on other stains, while retaining the improvement in brightness. The products containing sodium oleate exhibited superior stability, as compared to the control (0% sodium oleate separated after 3 days standing at room temperature; whereas 3% sodium oleate was unseparated after one week). Microscopy indicates incorporation of air in the formulations containing sodium oleate.

EXAMPLE 2

Compositions as shown in Table 2 were ground in an Attritor ball mill. Density of the final product, separation after centrifugation and density after centrifugation are also set forth in Table 2.

TABLE 2

| COMPONENT | RUN NO. 1 | 2 |
|---|---|---|
| PluraFac LF400 | 38.0 | 38.0 |
| DGMBE[1] | 10.25 | 10.25 |
| TPP-H[2] | 30.0 | 30.0 |
| Sokolan CP-5 Polymer (BASF) | 2.0 | 2.0 |
| Sodium Perborate Monohydrate | 11.0 | 11.0 |
| CMC[3] | 1.0 | 1.0 |
| Stearic Acid | 1.0 | — |
| Enzymes, Perfumes, Color and | Balance | Balance |
| Optical Brightener | 100 | 100 |
| Density (g/cc)[(a)] | 1.06 | 1.32 |
| Separation (%)[4] | 0 | 15 |
| Density (g/cc)[5(a)] | 1.07 | — |

[1]DGMBE = diethylene glycol monobutyl ether
[2]TPP-H = tripolyphosphate, acid form
[3]CMC = carboxy methyl cellulose
[4, 5]After centrifugation at approx. 50 G for 90 min.
[(a)]Liquid phase density is approx. 1.0 g/cc.

EXAMPLE 3

Formulations were prepared according to Table 3 (the fatty acid being added to the solid components, then the liquid components were mixed in and finally the entire mass was ground, as shown hereinbelow).

TABLE 3

| COMPONENT | Control | Runs |
|---|---|---|
| Tergitol 15-S-7 | 40.0 | 40.0 |
| Tergitol 24-L-60N | 9.0 | 9 0 |
| Sodium Tripolyphosphate | 30.3 | 29.8 |
| Sodium Perborate Monohydrate | 11.0 | 11.0 |
| TAED[1] | 4.5 | 4.5 |

TABLE 3-continued

| COMPONENT | Control | Runs |
|---|---|---|
| Sokolan CP-5 Polymer (BASF) | 2.0 | 2.0 |
| CMC[2] | 2.0 | 2.0 |
| $TiO_2$ | 0.2 | 0.2 |
| Minors | 1.0 | 1.0 |
| Air Stabilizer | — | 0.5 |

[1]TAED = tetra acetyl ethylene diamine
[2]CMC = carboxy methyl cellulose

A. Open System Grinding
(a-1)
Attritor: Union Process Model
01
Grind Time: 50 minutes ($N_2$ atm.)
Rotor Speed: 450 rpm
Water Jacket Temp.: tap water (80° F.)
Batch Size: 400 g
The results are set forth in Table A-1, below.

TABLE A-1

| Air Stabilizer | $N_{10}$ rpm[1] (cp) | Density (g/cc) |
|---|---|---|
| Control | 2,000 | 1.35 |
| Lauric Acid | 6,800 | 1.04 |
| Myristic Acid | 13,100 | 0.90 |
| Palmitic Acid | 11,400 | 0.98 |
| Stearic Acid | 14,300 | 1.00 |

[1]Brookfield RTVD viscometer, No. 4 spindle, 10 rpm (A-2)
Attritor: Union Process Model 1S
Grind Time: 50 minutes
Rotor Speed: 350 rpm
Water Jacket Temp.: tap water
Batch Size: 4.0 Kg
The results are set forth in Table A-2, below.

TABLE A-2

| Air Stabilizer | $N_{10}$ rpm[1] (cp) | Density (g/cc) |
|---|---|---|
| Control | 3,200 | 1.35 |
| Emersol 132 ®[2] | 22,400 | 0.83 |

[1]Brookfield RTVD viscometer, No. 4 spindle, 10 rpm
[2]Emery Chemicals (about 50% palmitic acid, 45% stearic acid)

B. Closed System Grinding and Post-Aeration
(B-1) Grinding
Netzsch Molinex Continuous Feed Ball Mill
(Netzsch, Inc., four-liter chamber (two pass))
Residence Time: 3 minutes/pass
Agitator Speed: 1,800 rpm
Premix Batch Size: 25.0 Kg
The results of the grinding operation are set forth in Table B-1, below.

TABLE B-1

| Batch | Air Stabilizer | $N_{10}$ rpm[1] (cp) | Density (g/cc) |
|---|---|---|---|
| A | Emersol 132 ®[2] | 14,700 | 1.17 |
| B | Palmitic Acid | 12,600 | 1.23 |
| C | Stearic Acid | 11,900 | 1.17 |

[1]Brookfield RTVD viscometer, No. 4 spindle, 10 rpm
[2]Emery Chemicals (about 50% palmitic acid, 45% stearic acid)

(B-2) Post-Aeration
Samples of batches A, B and C were then subjected to various post-aeration techniques and the results are shown in Table B-2, below.

TABLE B-2

| Batch | Aeration Method (Mixing) | Density (g/cc) |
|---|---|---|
| A | Attritor - 50 min. | 0.83 |
| B | Attritor - 10 min. | 0.88 |
| B | Rustin Blade - 10 min. | 1.00 |
| C | Propeller - 10 min. | 1.08 |

After standing two weeks at room temperature, the postaerated samples remained stable, while a ring of supernatant liquid (approx. 1–2 mm thick) was visible in all three original batches.

EXAMPLE 4

In a manner similar to Example 3 A-1, the following compositions were prepared and then subjected to stability testing, the formulations and results are set forth in Table 4, below.

TABLE 4

| COMPONENT | RUN CONTROL | 1 | 2 |
|---|---|---|---|
| Tergitol 15-S-7 | 40.0 | 40.0 | 40.0 |
| Tergitol 24-L-60N | 9.0 | 9.0 | 9.0 |
| Sodium Tripolyphosphate | 30.4 | 29.8 | 29.8 |
| Sodium Perborate Monohydrate | 11.0 | 11.0 | 11.0 |
| TAED[1] | 4.5 | 4.5 | 4.5 |
| Sokolan CP-5 Polymer (BASF) | 2.0 | 2.0 | 2.0 |
| CMC[2] | 2.0 | 2.0 | 2.0 |
| Glycerol Stearate[3] | — | 0.6 | — |
| Emersol 132 ®[4] | — | — | 0.6 |
| Enzymes, Color Optical | Balance | Balance | Balance |
| Brightener, Perfume | 100 | 100 | 100 |
| SHAKE TEST[5] | | | |
| Density 1 (g/ml) | 1.32 | 1.005 | 1.00 |
| Density 2 (g/ml) | — | 1.03 | 1.08 |
| % Density Change | — | 2.4 | 8.0 |
| CENTRIFUGE TEST[6] | | | |
| Density 1 | 1.32 | 1.005 | 1.00 |
| Density 2 | — | 1.08 | 1.11 |
| % Density Change | — | 7.4 | 10.1 |
| % Separation | 15.1 | 0 | 0 |
| High Temperature Aging[7] | | | |
| Density 1 | 1.32 | 1.005 | 1.00 |
| Density 2 | — | 1.01 | 1.06 |
| % Density Change | — | 0.5 | 4.9 |
| % Separation | 8.6 | 0 | 0 |

[1]TAED = tetra acetyl ethylene diamine
[2]CMC = carboxy methyl cellulose
[3]Witco Chemical 65% glycerol monostearate and 30% glycerol distearate
[4]Emery Chemical about 50% palmitic acid and about 45% stearic acid
[5]Samples placed on vibratory table and vibrated at 3,000 cycles/min. for 8 hours, density measured before (1) and after (2) test
[6]Samples were subjected to centrifugation at 50 G for 30 minutes, density measured before (1) and after (2) test
[7]Samples were allowed to stand for one week at 100° F, density measured before (1) and after (2) test

EXAMPLE 5

Figure 2:
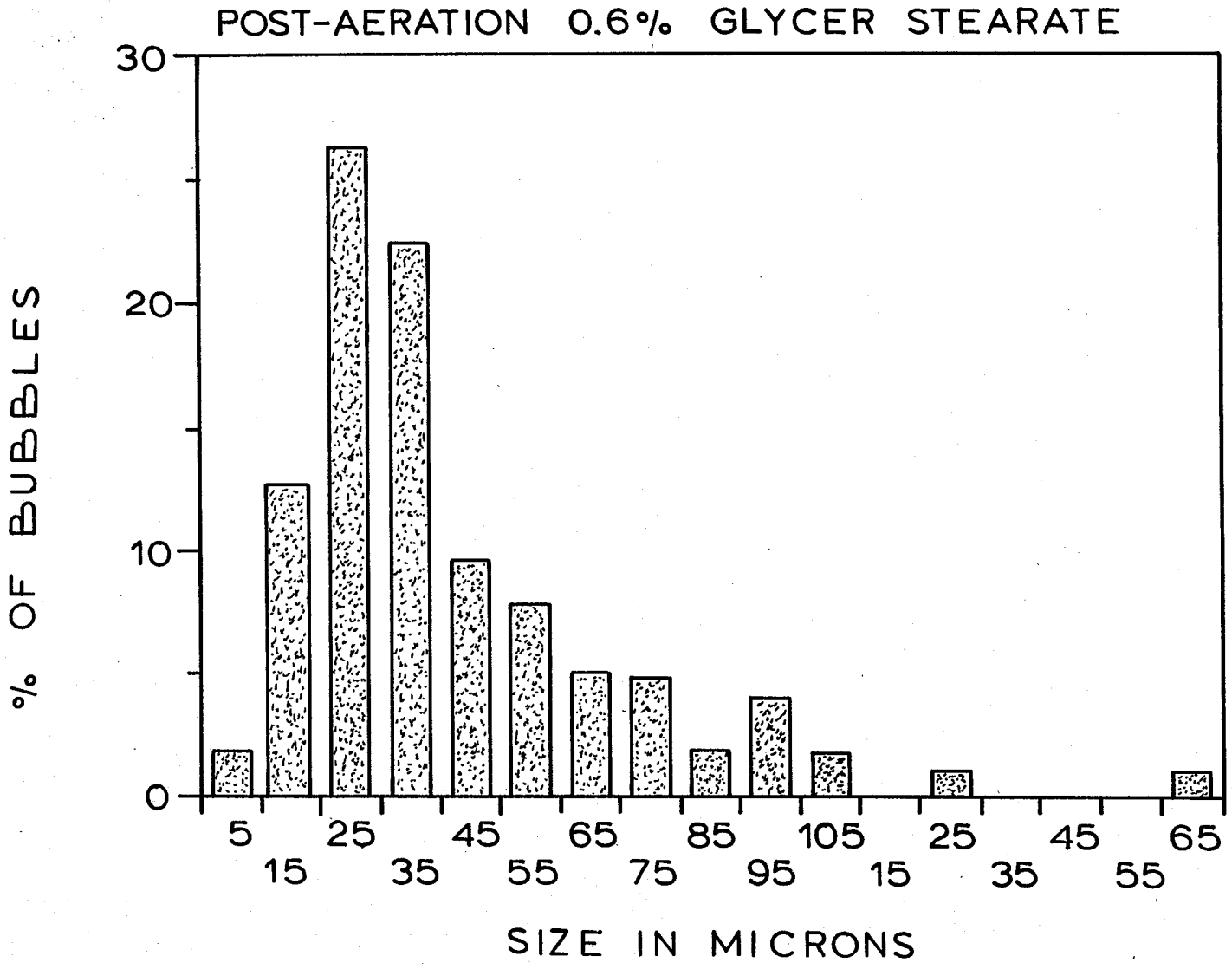
FIG. 2 is a bar graph showing the bubble size distribution produced with a glycerol stearate as air stabilizer using a post-aeration technique (subsequent to grinding).
Figure 3:
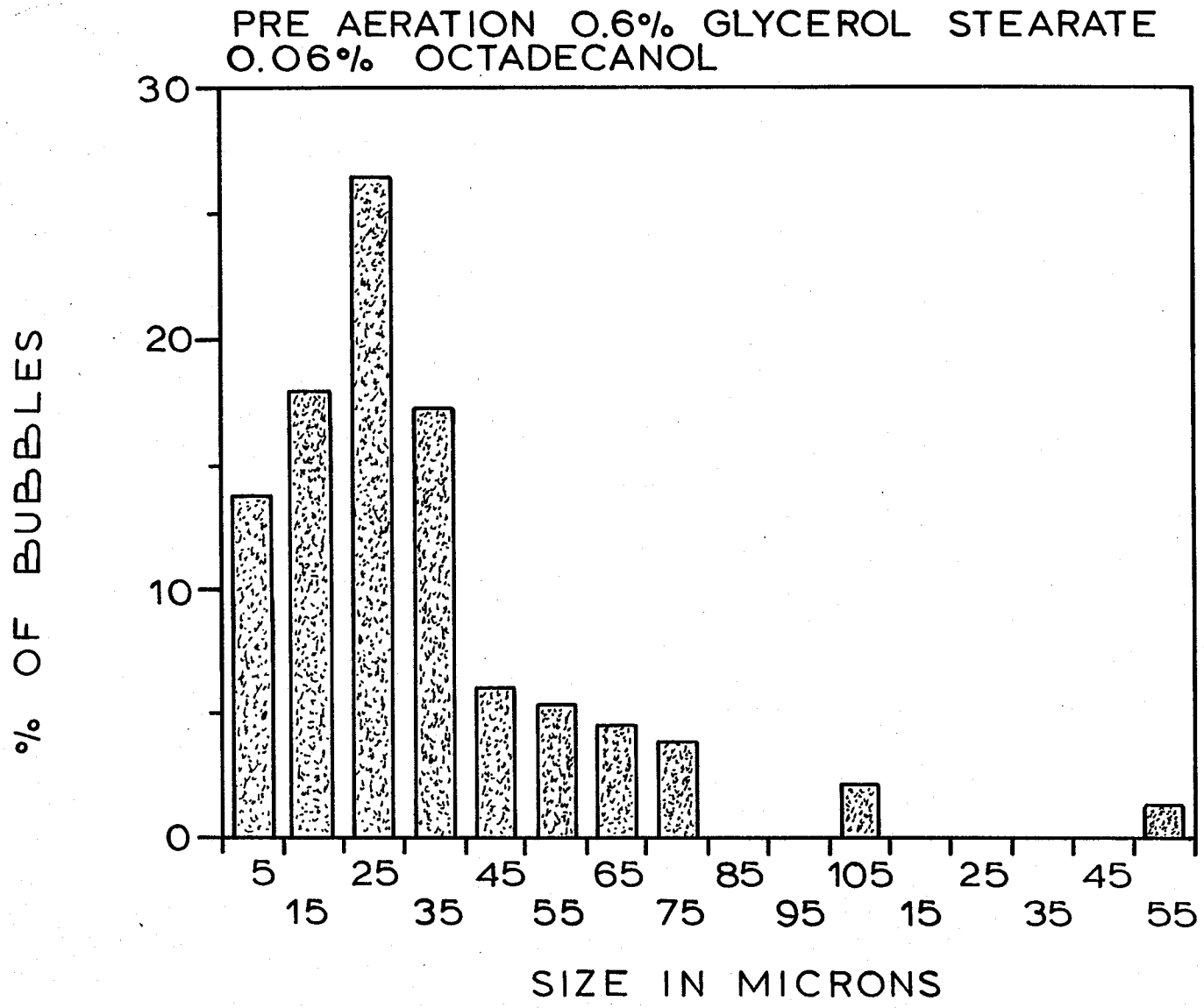
FIG. 3 is a bar graph showing the bubble size distribution produced with a glycerol stearate/octadecanol mixture as air stabilizer using a pre-aeration technique.
Figure 4:
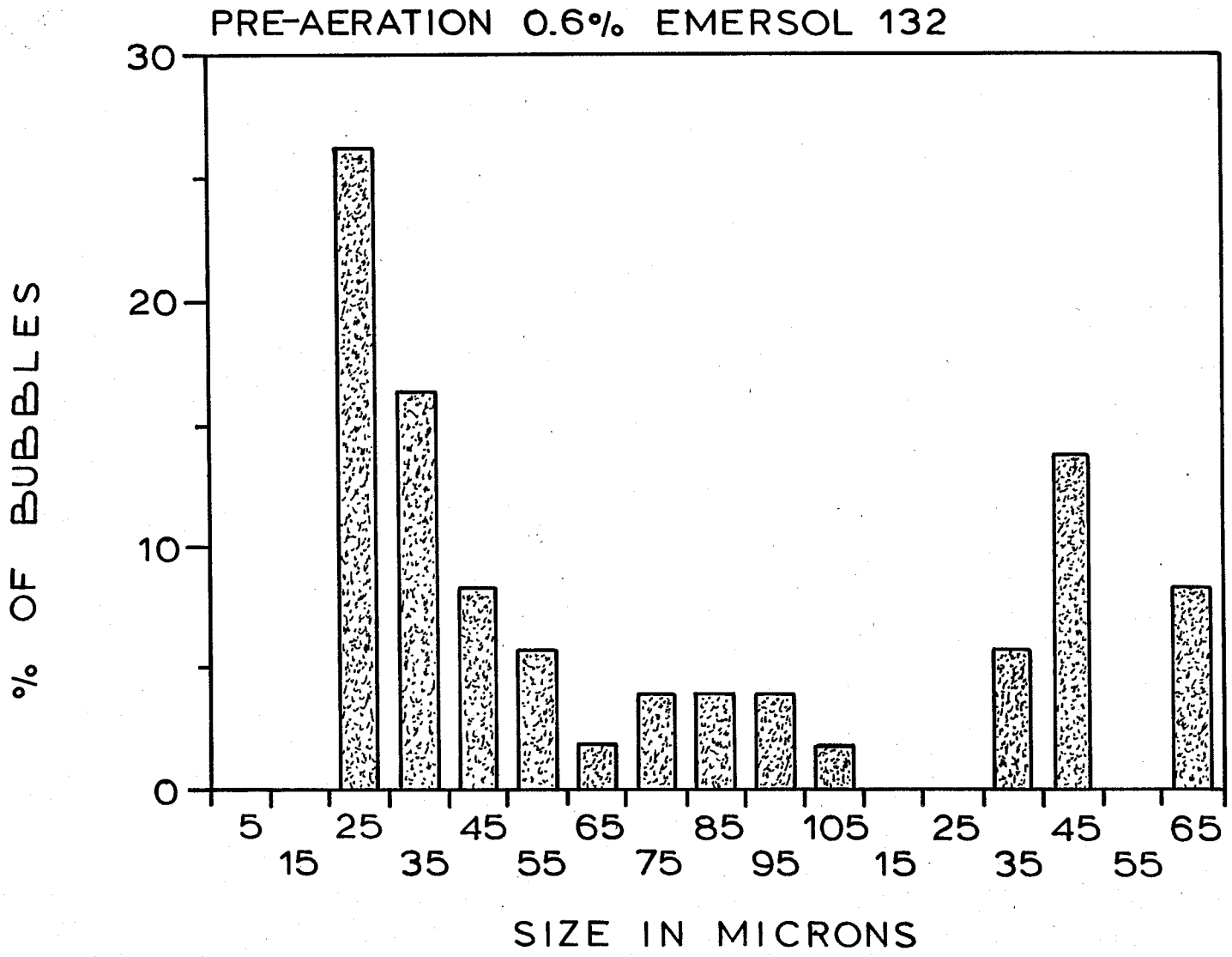
FIG. 4 is a bar graph showing the bubble size distribution produced with a fatty acid air stabilizer using a pre-aeration technique.
Figure 5:
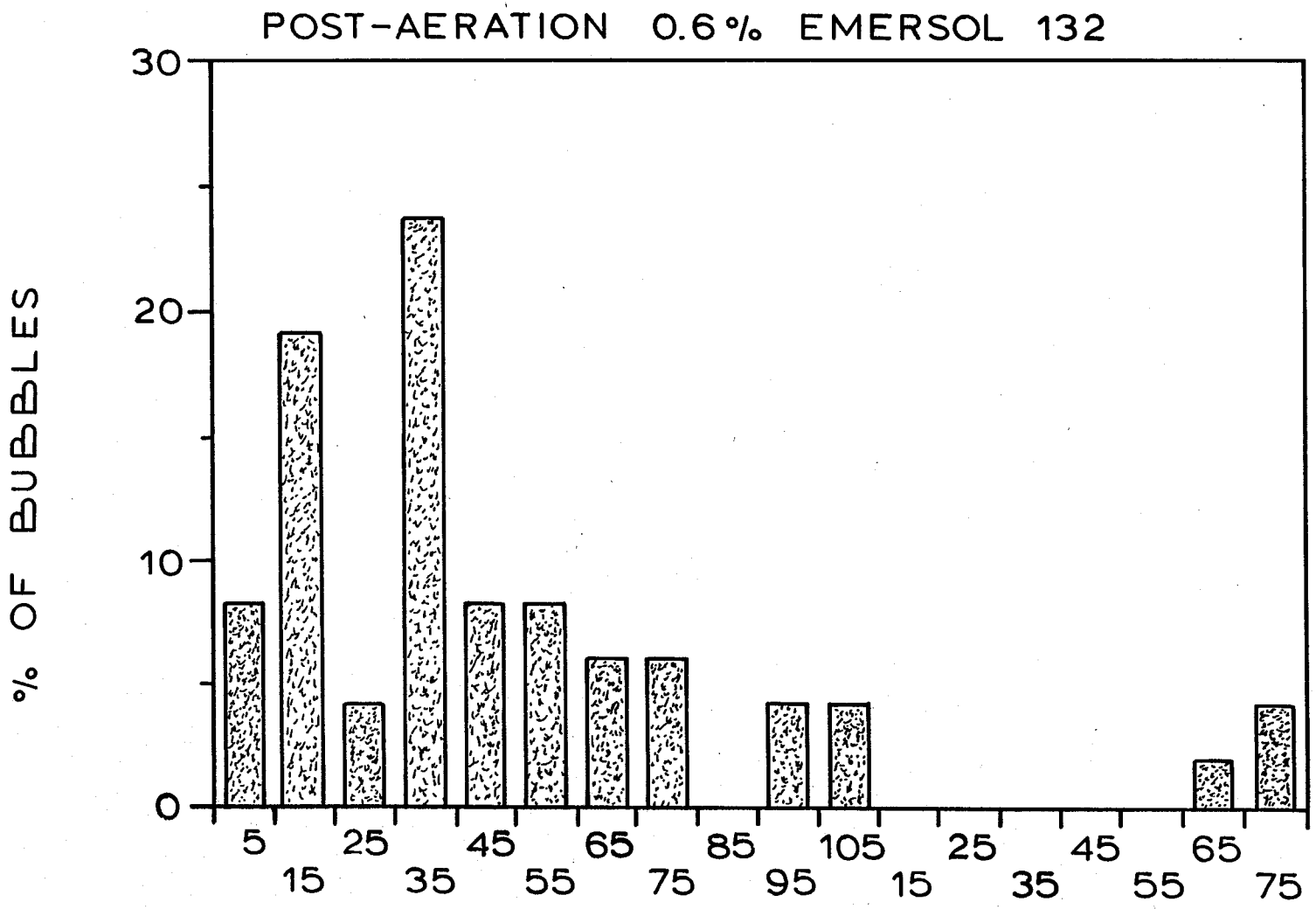
FIG. 5 is a bar graph showing the bubble size distribution produced with a fatty acid air stabilizer using a post-aeration technique.
Figure 6:
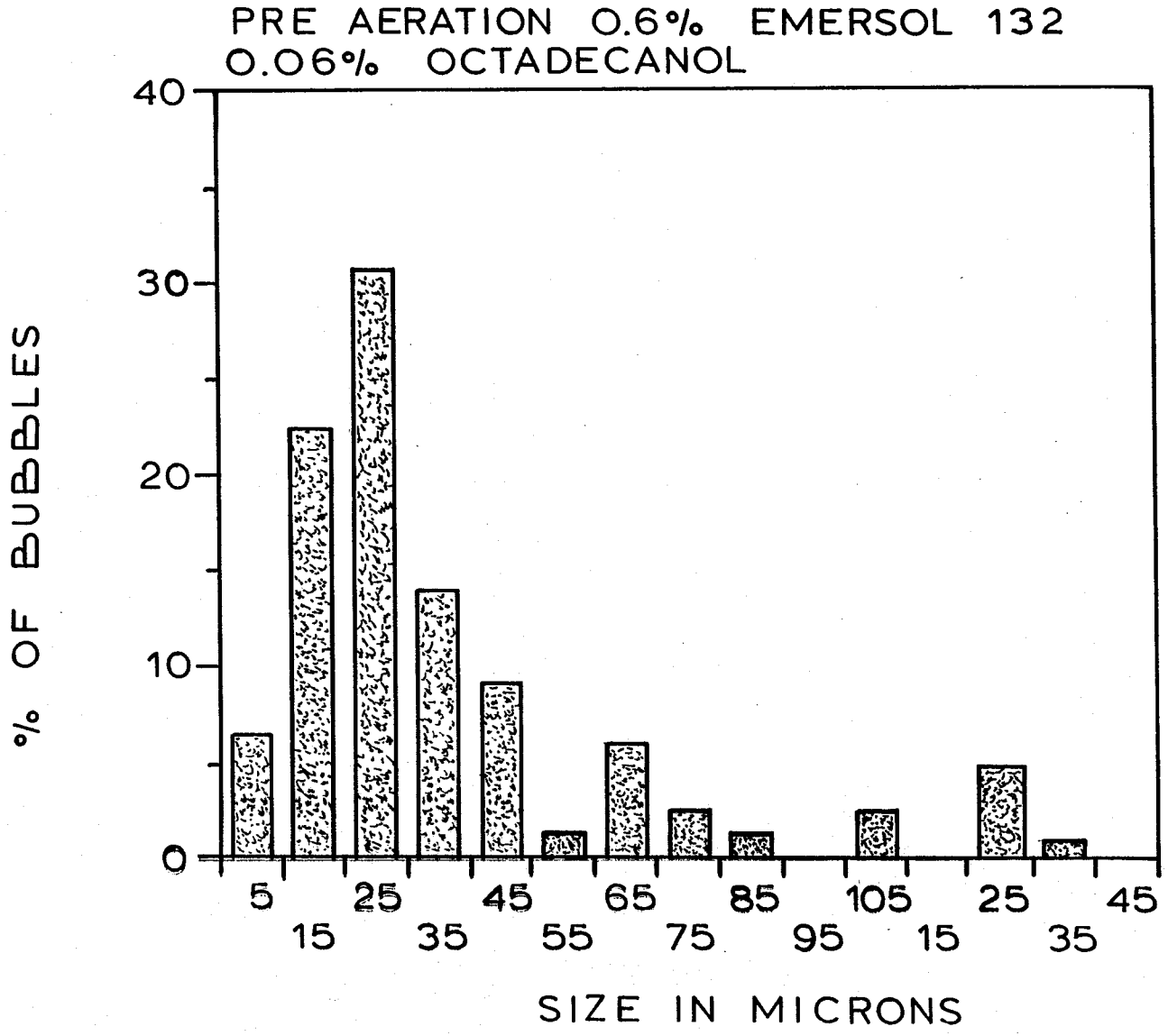
FIG. 6 is a bar graph showing the bubble size distribution produced with a mixed fatty acid/octadecanol air stabilizer using a pre-aeration technique.

The compositions of Runs 1 and 2 of Example 4 were each prepared in the manner of Example 3 A-1 and 3 B-2 and examined microscopically to determine the bubble size. Additionally, compositions of Runs 1 and 2 of Example 4, with the addition of 0.06% octadecanol, were also prepared in the manner of Example 3 A-1 and examined microscopically to determine the bubble size. The results are shown in FIGS. 1–6.

The mean bubble size for each sample was calculated for 75% of the data of the lower region. The upper extremities were left out since they represent only large unstabilized bubbles which dissipate from the system quickly. Suspended particles were determined by an HIAC instrument and set at 4.2 microns.

The results are set forth in Table 5, below.

TABLE 5

| Air Stabilizer | Aeration | Bubble Size (μ) | SRF | Separation[1] (%) |
|---|---|---|---|---|
| 0.6% GS[2] | Pre- | 28.4 | 7:1 | 2.9 |
| 0.6% GS[2] | Post- | 28.4 | 7:1 | 2.8 |
| 0.6% GS[2] + 0.6% ROH[3] | Pre- | 26.1 | 6:1 | 1.2 |
| 0.6% 132[4] | Pre- | 61.4 | 15:1 | 5.6 |
| 0.6% 132[4] | Post- | 32.0 | 8:1 | 3.1 |
| 0.6% 132[4] + 0.6% ROH[3] | Pre- | 27.3 | 6:1 | 1.4 |
| Control | — | 0 | — | 10.8 |

[1]After aging 8 weeks at room temperature
[2]GS = glycerol stearate (Witco Chemical, 65% glycerol monostearate and 30% glycerol distearate)
[3]ROH = octadecanol
[4]132 = Emersol 132 ® (Emery Chemical, about 50% palmitic acid and about 45% stearic acid)

As may be readily ascertained from FIGS. 1–6, the use of a fatty alcohol produces a more Gaussian distribution of the bubble sizes, and tends to shift the bubble sizes to the lower end. Thus, the fatty alcohol significantly aids the control of bubble size and the distribution of bubble sizes.

EXAMPLE 6

The composition of Run 1 of Example 4 was prepared in the manner of Example 3 A-1 at different temperatures. The density of the resultant composition was then measured and the results are shown in Table 6, below.

TABLE 6

| Temperature (°F.) | Density (g/ml) |
|---|---|
| 85 | 1.20 |
| 80 | 1.18 |
| 75 | 1.11 |
| 70 | 1.04 |
| 65 | 1.005 |
| 60 | 0.9707 |
| 55 | 0.9321 |

What is claimed is:

1. A non-aqueous liquid fabric treating composition comprising:

a continuous non-aqueous liquid phase comprising a detersively effective amount of at least one nonionic surfactant;

a suspended particle phase comprising:

a detergent building effective amount of at least one particulate detergent builder salt suspended in said nonaqueous liquid phase, and gas bubbles, having an average size of from about 10 to about 100 microns, suspended in said nonaqueous liquid phase in an amount effective to substantially inhibit settling of said suspended particles; and an air bubble stabilizing effective amount of a stabilizer having the formula

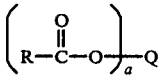

wherein

R is a hydrocarbon group of about 5 to 21 carbon atoms,

Q is a hydrogen atom, a Group IA metal, a Group IIA metal, a group having the formula

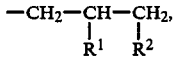

or a mixture thereof, wherein $R^1$ and $R^2$ are, independently, —OH or

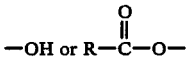

(R being as defined above), and a is 1 or 2, with the proviso that a=2 only when Q is a Group IIA metal.

2. The non-aqueous liquid fabric treating composition according to claim 1, wherein said air bubbles have an average size of from about 20 to about 70 microns.

3. The non-aqueous liquid fabric treating composition according to claim 2, wherein said air bubbles have an average size of from about 20 to about 30 microns.

4. The non-aqueous liquid fabric treating composition according to claim 1, wherein the ratio of the average size of said air bubbles to the average size of said particulate detergent builder salt is from about 10:1 to about 1:1.

5. The non-aqueous liquid fabric treating composition according to claim-4, wherein the ratio of the average size of said air bubbles to the average size of said particulate detergent builder salt is from about 9:1 to about 3:1.

6. The non-aqueous liquid fabric treating composition according to claim 5, wherein the ratio of the average size of said air bubbles to the average size of said particulate detergent builder salt is from about 9:1 to about 6:1.

7. The non-aqueous liquid fabric treating composition according to claim 1, wherein the average size of said particulate detergent builder salt is from about 1 to about 10 microns.

8. The non-aqueous liquid fabric treating composition according to claim 7, wherein the average size of said particulate detergent builder salt is from about 4 to 5 microns.

9. The non-aqueous liquid fabric treating composition according to claim 8, where the ratio of the average size of said air bubbles to the-average size of said particulate detergent builder salt is from about 9:1 to about 6:1.

10. The non-aqueous liquid fabric treating composition according to claim 1, wherein said at least one nonionic surfactant comprises an alkoxylated fatty alcohol, said fatty alcohol having from 10 to about 22 carbon atoms.

11. The non-aqueous liquid fabric treating composition according to claim 10, wherein said fatty alcohol has from about 12 to about 18 carbon atoms.

12. The non-aqueous liquid fabric treating composition according to claim 10, wherein said alkoxylated fatty alcohol contains up to about 14 moles of ethylene oxide.

13. The non-aqueous liquid fabric treating composition according to claim 12, wherein said alkoxylated fatty alcohol contains from about 3 to about 12 moles of ethylene oxide.

14. The non-aqueous liquid fabric treating composition according to claim 10, wherein said alkoxylated fatty alcohol contains up to about 14 moles of propylene oxide.

15. The non-aqueous liquid fabric treating composition according to claim 14, wherein said alkoxylated fatty alcohol contains from about 3 to about 8 moles of propylene oxide.

16. The non-aqueous liquid fabric treating composition according to claim 10, wherein said fatty alcohol comprises a secondary alcohol.

17. The non-aqueous liquid fabric treating composition according to claim 1, wherein said continuous non-aqueous liquid phase further comprises a viscosity controlling and anti-gelling amount of an alkylene glycol ether of the formula $$RO(CH_2CH_2O)_nH$$

wherein R is an alkyl group of 2 to 8 carbon atoms and n is a number of from about 1 to about 6.

18. The non-aqueous liquid fabric treating composition according to claim 7, wherein said alkylene glycol ether comprises diethylene glycol monobutyl ether.

19. The non-aqueous liquid fabric treating composition of claim 1, wherein said continuous non-aqueous liquid phase comprises from about 30% to about 70% by weight of the composition and said suspended particle phase comprises from about 70% to about 30% by weight of the composition.

20. The non-aqueous liquid fabric treating composition of claim 19, wherein said continuous non-aqueous liquid phase comprises from about 50% to about 60% by weight of the composition and said suspended particle phase comprises from about 40% to about 50% by weight of the composition.

21. The non-aqueous liquid fabric treating composition of claim 1, wherein said stabilizer is present in an amount of from about 0.01% to about 5.0 by weight of said composition.

22. The non-aqueous liquid fabric treating composition of claim 21, wherein said stabilizer is present in an amount of from about 0.5% to about 4.0% by weight of said composition.

23. The non-aqueous liquid fabric treating composition of claim 22, wherein said stabilizer is present in an amount of from about 0.5% to about 1.5% by weight of said composition.

24. The non-aqueous liquid fabric treating composition of claim 1, wherein Q is a hydrogen atom.

25. The non-aqueous liquid fabric treating composition of claim-24, wherein R is a hydrocarbon group of about 11 to about 20 carbon atoms.

26. The non-aqueous liquid fabric treating composition of claim 25, wherein R is a hydrocarbon group of about 15 to about 17 carbon atoms.

27. The non-aqueous liquid fabric treating composition of claim 26, wherein said acid comprises stearic acid.

28. The non-aqueous liquid fabric treating composition of claim 1, wherein Q is a Group IA metal or a Group IIA metal.

29. The non-aqueous liquid fabric treating composition of claim 28, wherein Q is a Group IA metal and R is a hydrocarbon group of about 11 to about 19 carbon atoms.

30. The non-aqueous liquid fabric treating composition of claim 29, wherein said Group IA metal is sodium and R is a hydrocarbon group of about 15 to about 17 carbon atoms.

31. The non-aqueous liquid fabric treating composition of claim 30, wherein said stabilizer comprises sodium oleate.

32. The non-aqueous liquid fabric treating composition of claim 1, wherein Q is a group having the formula $$-CH_2-\underset{\underset{R^1}{|}}{CH}-\underset{\underset{R^2}{|}}{CH_2}.$$

33. The non-aqueous liquid fabric treating composition of claim 32, wherein R is a hydrocarbon group of about 11 to about 19 carbon atoms.

34. The non-aqueous liquid fabric treating composition of claim 33, wherein R is a hydrocarbon group of about 15 to about 17 carbon atoms.

35. The non-aqueous liquid fabric treating composition of claim 1, wherein said stabilizer comprises a mixture of a glycerol monoester and a glycerol diester.

36. The non-aqueous liquid fabric treating composition of claim 35, wherein said stabilizer comprises a mixture of glycerol monostearate and glycerol distearate.

37. The non-aqueous liquid fabric treating composition of claim 36, wherein said stabilizer comprises a mixture of about 65% by weight of glycerol monostearate and about 35% by weight of glycerol distearate.

38. The non-aqueous liquid fabric treating composition of claim 37, wherein said stabilizer is present in an amount of about 0.5% to about 1.5% by weight of said composition.

39. The non-aqueous liquid fabric treating composition of claim 38, wherein said stabilizer further comprises a fatty alcohol of 12 to 20 carbon atoms.

40. The non-aqueous liquid fabric treating composition of claim 39, wherein said fatty alcohol is present in an amount of about 1/10 that of said mixture of glycerol monostearate and glycerol distearate.

41. The non-aqueous liquid fabric treating composition of claim 40, wherein said fatty alcohol is octadecanol.

42. The non-aqueous liquid fabric treating composition of claim 1, wherein said suspended particle phase further comprises a particulate low density filler having an average size of from about 1 to about 300 microns, said low density filler being present in an amount which in conjunction with said air bubbles substantially equalizes the density of said non-aqueous liquid phase and the density of said suspended particle phase, inclusive of said low density filler, said air bubbles and said at least one particulate detergent builder salt, to inhibit settling of said suspended particles.

43. The non-aqueous liquid fabric treating composition of claim 42, wherein said low density filler has an average particle size of about 4 to about 200 microns.

44. The non-aqueous liquid fabric treating composition of claim 43, wherein said low density filler has an average particle size of about 20 to about 100 microns.

45. The non-aqueous liquid fabric treating composition of claim 44, wherein said low density filler has an average particle size of about 30 to about 80 microns.

46. The non-aqueous liquid fabric treating composition of claim 42, wherein said low density filler has a density of about 0.01 to 0.50 g/cc.

47. The non-aqueous liquid fabric treating composition of claim 46, wherein said low density filler has a density of about 0.01 to 0.20 g/cc.

48. The non-aqueous liquid fabric treating composition of claim 42, wherein said low density filler is water-soluble.

49. The non-aqueous liquid fabric treating composition of claim 1, wherein said at least one non-ionic surfactant is present in an amount of about 20% to about 70% by weight of said composition.

50. The non-aqueous liquid fabric treating composition of claim 49, wherein said at least one non-ionic surfactant is present in an amount of about 30% to about 50% by weight of said composition.

51. The non-aqueous liquid fabric treating composition of claim 1, wherein said at least one detergent builder salt is water-soluble or water-dispersible.

52. The non-aqueous liquid fabric treating composition of claim 51, wherein said detergent builder salt is present in an amount of about 10% to about 60% by weight of said composition.

53. The non-aqueous liquid fabric treating composition of claim 52, wherein said detergent builder salt is present in an amount of about 25% to about 40% by weight of said composition.

54. The non-aqueous liquid fabric treating composition of claim 1, wherein said gas bubbles are present in an amount to substantially equalize the density of said continuous non-aqueous liquid phase and the density of said suspended particle phase, inclusive of said gas bubbles and said at least one particulate detergent builder salt.

55. The non-aqueous liquid fabric treating composition of claim 54, wherein said gas bubbles are present in an amount of about 0.005% to about 1.0% by weight of said composition.

56. The non-aqueous liquid fabric treating composition of claim 54, wherein the ratio of the density of said continuous non-aqueous liquid phase to the density of said suspended particle phase, inclusive of said gas bubbles and said at least one particulate detergent builder salt, is about 0.90 to about 1.10.

57. The non-aqueous liquid fabric treating composition of claim 56, wherein said ratio of densities is about 0.95 to about 1.05.

58. A method of producing a stable non-aqueous liquid fabric treating composition comprising:

a continuous non-aqueous liquid phase comprising a detersively effective amount of at least one non-ionic surfactant;

a suspended particle phase comprising:

a detergent building effective amount of at least one particulate detergent builder salt suspended in said nonaqueous liquid phase, and gas bubbles, having an average size of from about 10 to about 100 microns, suspended in said non-aqueous liquid phase in an amount to effectively substantially inhibit settling of said suspended particles; and a gas bubble stabilizing effective amount of a stabilizer having the formula

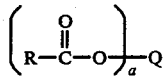

wherein

R is a hydrocarbon group of about 5 to about 21 carbon atoms

Q is a hydrogen atom, a Group IA metal, a Group IIA metal, a group having the formula

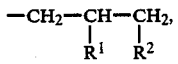

or a mixture thereof, wherein $R^1$ and $R^2$ are, independently, —OH or

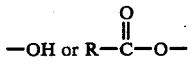

(R being as defined above), and a is 1 or 2, with the proviso that a=2 only when Q is a Group IIA metal, said process comprising the steps of:

(1) admixing said stabilizer, said at least one detergent builder salt, and said at least one non-ionic surfactant; and (2) subjecting said admixture of step (1) to grinding and aeration conditions sufficient to produce said particulate suspended particle phase.

59. The method according to claim 54, wherein said grinding and aeration occur simultaneously.

60. The method according to claim 54, wherein said aeration occurs subsequent to said grinding.

61. The method according to claim 54, wherein said step (1) comprises the steps (a) admixing said stabilizer and said at least one detergent; and then (b) admixing said at least one nonionic surfactant with said admixture of step (a).

* * * * *